US008752830B2

(12) United States Patent
Fukusaka et al.

(10) Patent No.: US 8,752,830 B2
(45) Date of Patent: Jun. 17, 2014

(54) SHEET FEEDER THAT DETECTS MULTI-FEED OF SHEETS AND IMAGE FORMING APPARATUS

(71) Applicant: Canon Kabushiki Kaisha, Tokyo (JP)

(72) Inventors: Tetsuro Fukusaka, Abiko (JP); Yoshitaka Yamazaki, Abiko (JP); Taishi Tomii, Matsudo (JP)

(73) Assignee: Canon Kabushiki Kaisha (JP)

( * ) Notice: Subject to any disclaimer, the term of this patent is extended or adjusted under 35 U.S.C. 154(b) by 0 days.

(21) Appl. No.: 13/949,308

(22) Filed: Jul. 24, 2013

(65) Prior Publication Data

US 2014/0027971 A1 Jan. 30, 2014

(30) Foreign Application Priority Data

Jul. 26, 2012 (JP) ..... 2012-165865

(51) Int. Cl.
*B65H 3/46* (2006.01)
*B65H 7/12* (2006.01)

(52) U.S. Cl.
CPC .. *B65H 3/46* (2013.01); *B65H 7/12* (2013.01); *B65H 7/125* (2013.01); *B65H 2511/524* (2013.01); *B65H 2553/30* (2013.01)
USPC ..... 271/262; 271/258.01

(58) Field of Classification Search
CPC ..... B65H 3/46; B65H 7/12; B65H 7/125
See application file for complete search history.

(56) References Cited

U.S. PATENT DOCUMENTS

| | | | | |
|---|---|---|---|---|
| 6,540,222 | B2 * | 4/2003 | Araki et al. | 271/122 |
| 7,130,245 | B2 * | 10/2006 | Okitsu et al. | 367/125 |
| 8,047,541 | B2 * | 11/2011 | Segawa | 271/265.04 |
| 8,266,965 | B2 * | 9/2012 | Schoen | 73/598 |
| 8,567,776 | B2 * | 10/2013 | Niwano et al. | 271/262 |
| 2008/0203654 | A1 * | 8/2008 | Chujo et al. | 271/262 |
| 2009/0230617 | A1 * | 9/2009 | Segawa | 271/264 |
| 2013/0216291 | A1 * | 8/2013 | Fukusaka et al. | 400/583 |

FOREIGN PATENT DOCUMENTS

JP 3890766 B2 3/2007

* cited by examiner

*Primary Examiner* — Kaitlin Joerger
(74) *Attorney, Agent, or Firm* — Rossi, Kimms & McDowell, LLP

(57) ABSTRACT

A sheet feeder which is capable of accurately detecting multi-feed of sheets even when the distance between sensors is changed. The sheet feeder includes a sheet container for holding a stack of sheets. Ultrasonic sensors for transmitting and receiving ultrasonic waves, respectively, are provided on a conveying path. The ultrasonic sensor as a transmitter transmits ultrasonic waves to a sheet being fed and conveyed. A reception circuit detects a level of ultrasonic waves received by the ultrasonic sensor as a receiver. The level of ultrasonic waves detected after lapse of a predetermined time from transmission of ultrasonic waves is compared with a predetermined threshold value to determine multi-feed of sheets. A distance between the ultrasonic sensors is detected, and at least one of the predetermined time period and the predetermined threshold value is corrected based on the detected distance between the sensors.

12 Claims, 26 Drawing Sheets

FIG. 9A

TEMPERATURE IN SHEET FEEDER: 25°C

| DISTANCE BETWEEN SENSORS (mm) | THRESHOLD VOLTAGE (mV) | | |
|---|---|---|---|
| | COATED PAPER LESS THAN 80 gsm | COATED PAPER NOT LESS THAN 80 gsm & LESS THAN 128 gsm | PAPER OF OTHER TYPES |
| 21.0 | 270 | 280 | 300 |
| 20.9 | 270 | 280 | 300 |
| 20.8 | 280 | 280 | 300 |
| 20.7 | 280 | 290 | 300 |
| 20.6 | 280 | 290 | 300 |
| 20.5 | 290 | 290 | 300 |
| 20.4 | 290 | 300 | 300 |
| 20.3 | 290 | 300 | 300 |
| 20.2 | 300 | 300 | 300 |
| 20.1 | 300 | 300 | 300 |
| 20.0 | 300 | 300 | 300 |
| 19.9 | 300 | 300 | 300 |
| 19.8 | 300 | 300 | 300 |
| 19.7 | 310 | 300 | 300 |
| 19.6 | 310 | 300 | 300 |
| 19.5 | 310 | 310 | 300 |
| 19.4 | 320 | 310 | 300 |
| 19.3 | 320 | 310 | 300 |
| 19.2 | 320 | 320 | 300 |
| 19.1 | 330 | 320 | 300 |
| 19.0 | 330 | 320 | 300 |

FIG. 9B

TEMPERATURE IN SHEET FEEDER: 0°C

| DISTANCE BETWEEN SENSORS (mm) | THRESHOLD VOLTAGE (mV) | | |
|---|---|---|---|
| | COATED PAPER LESS THAN 80 gsm | COATED PAPER NOT LESS THAN 80 gsm & LESS THAN 128 gsm | PAPER OF OTHER TYPES |
| 21.0 | 240 | 250 | 270 |
| 20.9 | 240 | 250 | 270 |
| 20.8 | 250 | 250 | 270 |
| 20.7 | 250 | 260 | 270 |
| 20.6 | 250 | 260 | 270 |
| 20.5 | 260 | 260 | 270 |
| 20.4 | 260 | 270 | 270 |
| 20.3 | 260 | 270 | 270 |
| 20.2 | 270 | 270 | 270 |
| 20.1 | 270 | 270 | 270 |
| 20.0 | 270 | 270 | 270 |
| 19.9 | 270 | 270 | 270 |
| 19.8 | 270 | 270 | 270 |
| 19.7 | 280 | 270 | 270 |
| 19.6 | 280 | 270 | 270 |
| 19.5 | 280 | 280 | 270 |
| 19.4 | 290 | 280 | 270 |
| 19.3 | 290 | 280 | 270 |
| 19.2 | 290 | 290 | 270 |
| 19.1 | 300 | 290 | 270 |
| 19.0 | 300 | 290 | 270 |

FIG. 9C

TEMPERATURE IN SHEET FEEDER: 60℃

| DISTANCE BETWEEN SENSORS (mm) | THRESHOLD VOLTAGE (mV) | | |
|---|---|---|---|
| | COATED PAPER LESS THAN 80 gsm | COATED PAPER NOT LESS THAN 80 gsm & LESS THAN 128 gsm | PAPER OF OTHER TYPES |
| 21.0 | 300 | 310 | 330 |
| 20.9 | 300 | 310 | 330 |
| 20.8 | 310 | 310 | 330 |
| 20.7 | 310 | 320 | 330 |
| 20.6 | 310 | 320 | 330 |
| 20.5 | 320 | 320 | 330 |
| 20.4 | 320 | 330 | 330 |
| 20.3 | 320 | 330 | 330 |
| 20.2 | 330 | 330 | 330 |
| 20.1 | 330 | 330 | 330 |
| 20.0 | 330 | 330 | 330 |
| 19.9 | 330 | 330 | 330 |
| 19.8 | 330 | 330 | 330 |
| 19.7 | 340 | 330 | 330 |
| 19.6 | 340 | 330 | 330 |
| 19.5 | 340 | 340 | 330 |
| 19.4 | 350 | 340 | 330 |
| 19.3 | 350 | 340 | 330 |
| 19.2 | 350 | 350 | 330 |
| 19.1 | 360 | 350 | 330 |
| 19.0 | 360 | 350 | 330 |

FIG. 11A

TEMPERATURE IN SHEET FEEDER: 25℃

| DISTANCE BETWEEN SENSORS (mm) | A/D CONVERSION TIMING (μs) | | |
|---|---|---|---|
| | COATED PAPER LESS THAN 80 gsm | COATED PAPER NOT LESS THAN 80 gsm & LESS THAN 128 gsm | PAPER OF OTHER TYPES |
| 21.0 | 127.5 | 125 | 120 |
| 20.9 | 127.5 | 125 | 120 |
| 20.8 | 125 | 125 | 120 |
| 20.7 | 125 | 122.5 | 120 |
| 20.6 | 125 | 122.5 | 120 |
| 20.5 | 122.5 | 122.5 | 120 |
| 20.4 | 122.5 | 120 | 120 |
| 20.3 | 122.5 | 120 | 120 |
| 20.2 | 120 | 120 | 120 |
| 20.1 | 120 | 120 | 120 |
| 20.0 | 120 | 120 | 120 |
| 19.9 | 120 | 120 | 120 |
| 19.8 | 120 | 120 | 120 |
| 19.7 | 117.5 | 120 | 120 |
| 19.6 | 117.5 | 120 | 120 |
| 19.5 | 117.5 | 117.5 | 120 |
| 19.4 | 115 | 117.5 | 120 |
| 19.3 | 115 | 117.5 | 120 |
| 19.2 | 115 | 115 | 120 |
| 19.1 | 112.5 | 115 | 120 |
| 19.0 | 112.5 | 115 | 120 |

FIG. 11B

TEMPERATURE IN SHEET FEEDER: 0℃

| DISTANCE BETWEEN SENSORS (mm) | A/D CONVERSION TIMING (μs) | | |
|---|---|---|---|
| | COATED PAPER LESS THAN 80 gsm | COATED PAPER NOT LESS THAN 80 gsm & LESS THAN 128 gsm | PAPER OF OTHER TYPES |
| 21.0 | 135 | 132.5 | 127.5 |
| 20.9 | 135 | 132.5 | 127.5 |
| 20.8 | 132.5 | 132.5 | 127.5 |
| 20.7 | 132.5 | 130 | 127.5 |
| 20.6 | 132.5 | 130 | 127.5 |
| 20.5 | 130 | 130 | 127.5 |
| 20.4 | 130 | 127.5 | 127.5 |
| 20.3 | 130 | 127.5 | 127.5 |
| 20.2 | 127.5 | 127.5 | 127.5 |
| 20.1 | 127.5 | 127.5 | 127.5 |
| 20.0 | 127.5 | 127.5 | 127.5 |
| 19.9 | 127.5 | 127.5 | 127.5 |
| 19.8 | 127.5 | 127.5 | 127.5 |
| 19.7 | 125 | 127.5 | 127.5 |
| 19.6 | 125 | 127.5 | 127.5 |
| 19.5 | 125 | 125 | 127.5 |
| 19.4 | 122.5 | 125 | 127.5 |
| 19.3 | 122.5 | 125 | 127.5 |
| 19.2 | 122.5 | 122.5 | 127.5 |
| 19.1 | 120 | 122.5 | 127.5 |
| 19.0 | 120 | 122.5 | 127.5 |

FIG. 11C

TEMPERATURE IN SHEET FEEDER: 60℃

| DISTANCE BETWEEN SENSORS (mm) | A/D CONVERSION TIMING (μs) | | |
|---|---|---|---|
| | COATED PAPER LESS THAN 80 gsm | COATED PAPER NOT LESS THAN 80 gsm & LESS THAN 128 gsm | PAPER OF OTHER TYPES |
| 21.0 | 120 | 117.5 | 112.5 |
| 20.9 | 120 | 117.5 | 112.5 |
| 20.8 | 117.5 | 117.5 | 112.5 |
| 20.7 | 117.5 | 115 | 112.5 |
| 20.6 | 117.5 | 115 | 112.5 |
| 20.5 | 115 | 115 | 112.5 |
| 20.4 | 115 | 112.5 | 112.5 |
| 20.3 | 115 | 112.5 | 112.5 |
| 20.2 | 112.5 | 112.5 | 112.5 |
| 20.1 | 112.5 | 112.5 | 112.5 |
| 20.0 | 112.5 | 112.5 | 112.5 |
| 19.9 | 112.5 | 112.5 | 112.5 |
| 19.8 | 112.5 | 112.5 | 112.5 |
| 19.7 | 110 | 112.5 | 112.5 |
| 19.6 | 110 | 112.5 | 112.5 |
| 19.5 | 110 | 110 | 112.5 |
| 19.4 | 107.5 | 110 | 112.5 |
| 19.3 | 107.5 | 110 | 112.5 |
| 19.2 | 107.5 | 107.5 | 112.5 |
| 19.1 | 105 | 107.5 | 112.5 |
| 19.0 | 105 | 107.5 | 112.5 |

SHEET FEEDER THAT DETECTS MULTI-FEED OF SHEETS AND IMAGE FORMING APPARATUS

BACKGROUND OF THE INVENTION

1. Field of the Invention

The present invention relates to a sheet feeder that detects multi-feed of conveyed sheets, and an image forming apparatus.

2. Description of the Related Art

A conventional multi-feed detection device is known which is provided with an ultrasonic transmitter and an ultrasonic receiver, for transmitting ultrasonic waves from the ultrasonic transmitter to a plurality of spots on a sheet material being conveyed, and detecting multi-feed of sheet materials based on an amount of attenuation of the ultrasonic waves received by the ultrasonic receiver (see Japanese Patent No. 3890766).

The above-mentioned conventional multi-feed detection device irradiates a plurality of spots on a sheet material with ultrasonic waves, and determines an occurrence of multi-feed of sheet materials if there are a predetermined or larger number of spots where the amount of attenuation of the ultrasonic waves is larger than a reference value due to superposition of sheet materials.

Variation in distance between the ultrasonic transmitter and the ultrasonic receiver (distance between the sensors) is considered to be a factor degrading the accuracy of multi-feed detection. The variation in distance between the sensors sometimes increases or decreases the level of output from the ultrasonic receiver. The above-mentioned conventional multi-feed detection device cannot cope with this variation in distance between the sensors. Particularly, in a case where the ultrasonic transmitter and the ultrasonic receiver are disposed in a manner spaced from each other so as to make it easier for a user to remove a jammed sheet caused by paper jam occurring in the vicinity of the sensors, the distance between the sensors may be changed whenever a paper jam occurs. Further, when the distance between the sensors has changed, there is a possibility that the multi-feed detection device cannot detect multi-feed of sheet materials, or erroneously detects multi-feed of sheet materials which are being fed normally.

SUMMARY OF THE INVENTION

The present invention provides a sheet feeder which is capable of accurately detecting multi-feed of sheets even when the distance between sensors has changed, and an image forming apparatus.

In a first aspect of the present invention, there is provided a sheet feeder comprising a container unit configured to contain a plurality of sheets, a feeding unit configured to feed sheets from the container unit, a transmitter configured to transmit ultrasonic waves to a sheet being fed by the feeding unit, a receiver configured to receive ultrasonic waves transmitted by the transmitter, a first detection unit configured to detect a level of ultrasonic waves received by the receiver, a determination unit configured to determine whether or not sheets are being multi-fed, by comparing the level of ultrasonic waves detected by the first detection unit after lapse of a predetermined time period from transmission of the ultrasonic waves by the transmitter with a predetermined threshold value, a second detection unit configured to detect a distance between the transmitter and the receiver, and a changing unit configured to change at least one of the predetermined time period and the predetermined threshold value based on the distance detected by the second detection unit.

In a second aspect of the present invention, there is provided an image forming apparatus comprising a container unit configured to contain a plurality of sheets, a feeding unit configured to feed sheets from the container unit, a transmitter configured to transmit ultrasonic waves to a sheet being fed by the feeding, a receiver configured to receive ultrasonic waves transmitted by the transmitter, a first detection unit configured to detect a level of ultrasonic waves received by the receiver, a determination unit configured to determine whether or not sheets are being multi-fed, by comparing the level of ultrasonic waves detected by the first detection unit after lapse of a predetermined time period from transmission of the ultrasonic waves by the transmitter with a predetermined threshold value, a second detection unit configured to detect a distance between the transmitter and the receiver, a changing unit configured to change at least one of the predetermined time period and the predetermined threshold value based on the distance detected by the second detection unit, and an image forming unit configured to form an image on a sheet which is determined by the determination unit not to be being multi-fed.

According to the present invention, before performing detection of multi-feed of sheets, in a state in which no sheets are being conveyed, ultrasonic waves are transmitted by the transmitter unit and the transmitted ultrasonic waves are received by the receiver unit to thereby measure a time period taken for arrival of the ultrasonic waves. A distance between the transmitter unit and the receiver unit is calculated based on the time period. Further, the value of a parameter used for multi-feed determination is changed according to the calculated distance between the transmitter unit and the receiver unit. This makes it possible to accurately detect multi-feed of sheets even when the distance between the transmitter unit and the receiver unit has changed.

Further features of the present invention will become apparent from the following description of exemplary embodiments with reference to the attached drawings.

BRIEF DESCRIPTION OF THE DRAWINGS

FIGS. 9A to 9C are diagrams each showing a relationship between a distance between the ultrasonic sensors and a threshold voltage used for multi-feed determination.

FIGS. 11A to 11C are diagrams each showing a relationship between the distance between the ultrasonic sensors and analog-to-digital conversion timing.

DESCRIPTION OF THE EMBODIMENTS

The present invention will now be described in detail below with reference to the accompanying drawings showing embodiments thereof.

Figure 1:
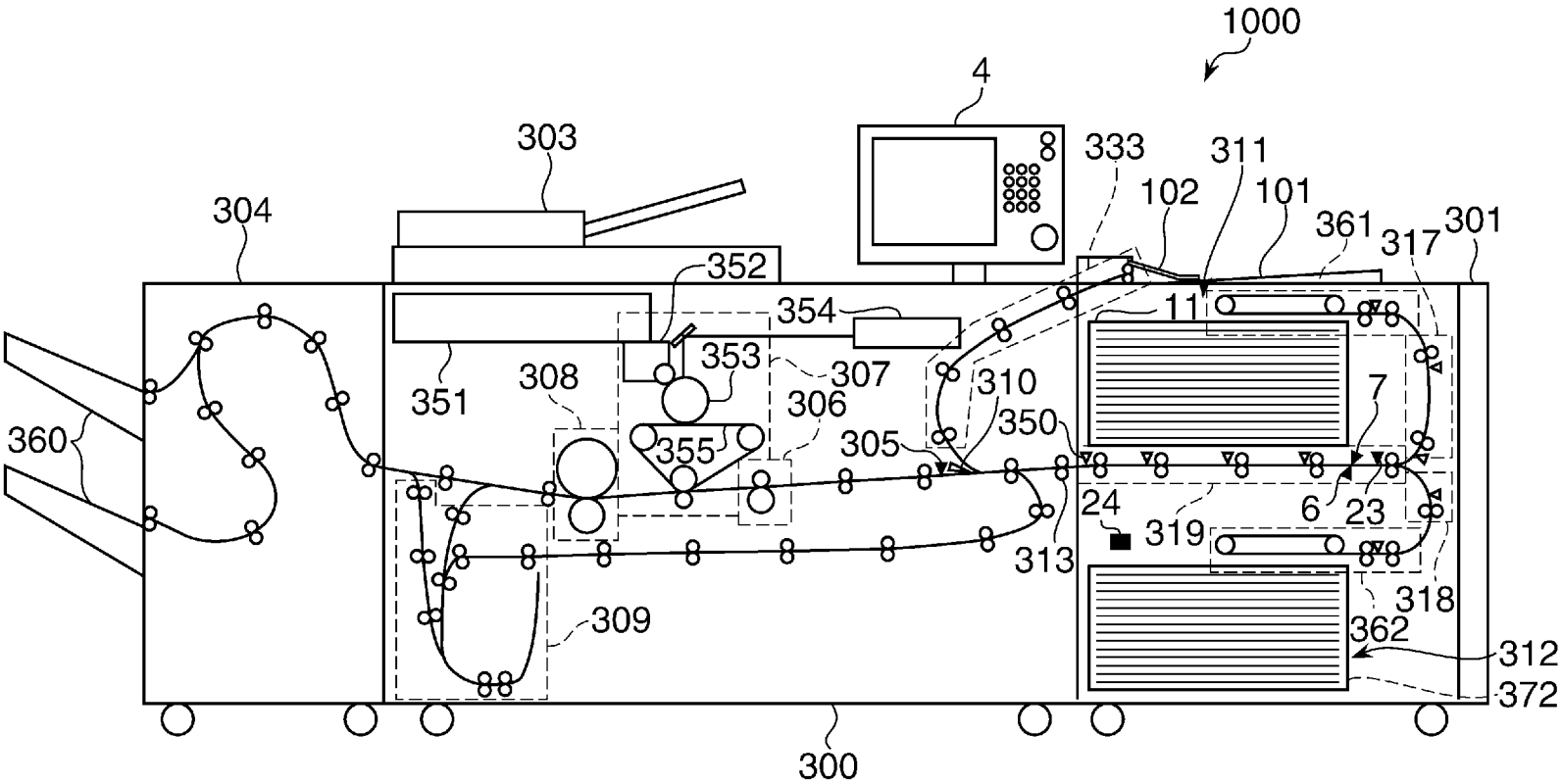
FIG. 1 is a schematic view, partly in cross-section, of an image forming system to which a sheet feeder according to a first embodiment of the present invention is applied.

FIG. 1 is a schematic view, partly in cross-section, of an image forming system 1000 to which a sheet feeder according to a first embodiment of the present invention is applied.

As shown in FIG. 1, the image forming system 1000 comprises a sheet feeder 301, an image forming apparatus 300, and a post-processing apparatus 304. A console section 4 and a reader scanner 303 are set on the image forming apparatus 300. Thus, in the present embodiment, the sheet feeder 301, the image forming apparatus 300, and the post-processing apparatus 304 are constructed separately from one another. However, this is not limitative, but all of the sheet feeder 301, the image forming apparatus 300, and the post-processing apparatus 304 may be integrally constructed, or the sheet feeder 301 and image forming apparatus 300 may be integrally constructed, and the post-processing apparatus 304 may be separately constructed. Alternatively, the image forming apparatus 300 and the post-processing apparatus 304 may be integrally constructed, and the sheet feeder 301 may be separately constructed.

The image forming system 1000 receives sheet processing settings input by a user using the console section 4 or a PC (personal computer; hereinafter referred to as the "external PC"), not shown, which is externally connected thereto. Then, the image forming system 1000 sequentially executes processing operations for feeding and conveying sheets, forming an image on each sheet which has been fed and conveyed, and post-processing on the sheet on which an image has been formed, based on the received sheet processing settings and image data sent from the reader scanner 303 or the external PC. As a result, the sheets (bundle) subjected to various kinds of post processing are output from the image forming system 1000 as products and are provided to the user.

The sheet feeder 301 comprises an upper sheet feeding unit 311 and a lower sheet feeding unit 312. The upper sheet feeding unit 311 and the lower sheet feeding unit 312 (sheet feeding unit) are provided with sheet containers 11 and 372, respectively, for holding a stack of sheets, from which sheets are fed on an as-needed basis.

The sheet feeder 301 is provided with an escape tray 101 on a top side thereof, onto which an abnormal sheet is discharged. A full-stack detection member 102 is provided for detecting a state in which the escape tray 101 is filled with abnormal sheets forcibly discharged.

The sheet-feeding operation is performed by suction conveyor units 361 and 362 that are provided in the sheet feeding units 311 and 312, respectively. In the present embodiment, the suction conveyor units 361 and 362 are each provided with a suction fan 36 and a loosening blower 32 (see FIG. 2), so as to cause a sheet to be attracted to a suction conveyor belt 21 of an endless type by air suction. During sheet-feeding operation, the loosening blower 32 is controlled such that air is blown between sheets in the sheet containers 11 and 372 from upstream of a sheet-conveying direction. When the sheets are loosened by air and made separate, one of the sheets is attracted to the suction conveyor belt 21 by negative pressure created by the suction fan 36, and is fed and conveyed. The operation of the suction conveyor units 361 and 362 for feeding and conveying sheets will be described in detail hereinafter with reference to FIGS. 2 and 3A to 3C.

Each sheet fed from the upper sheet feeding unit 311 continues to be conveyed by an upper conveying section 317. On the other hand, each sheet fed from the lower sheet feeding unit 312 continues to be conveyed by a lower conveying section 318. The sheets conveyed by the upper conveying section 317 and the lower conveying section 318, respectively, continue to be conveyed by a merged conveying passage section 319.

The conveying sections 317, 318, 319, 361, and 362 each include a stepper motor (not shown) for conveying sheets. Each stepper motor is controlled by a controller 302 (see FIG. 4). A driving force of each stepper motor is mechanically transmitted to rotate conveying rollers of each conveying section to thereby convey sheets.

Further, in the merged conveying passage section 319, ultrasonic sensors 6 and 7 for detecting multi-feed of conveyed sheets are disposed in a manner opposed to each other across a conveying passage. The one ultrasonic sensor 6 is a transmitter unit for transmitting ultrasonic waves, and the other ultrasonic sensor 7 is a receiver unit for receiving ultrasonic waves.

A temperature sensor 24 for detecting temperature of the inside of the sheet feeder 301 is disposed in the vicinity of the sheet container 372.

The sheet feeder 301 sequentially feeds and conveys sheets from one of the sheet containers 11 and 372 according to sheet request information received from the image forming apparatus 300. When the sheet feeder 301 conveys a sheet to a conveyance sensor 350 disposed at a location where a sheet is passed to the image forming apparatus 300, the sheet feeder 301 notifies the image forming apparatus 300 of completion of preparation for passing the sheet. Upon receipt of notification of the completion of passing preparation from the sheet feeder 301, the image forming apparatus 300 sends a sheet passing request to the sheet feeder 301. Whenever receiving the sheet passing request, the sheet feeder 301 feeds a sheet to the image forming apparatus 300. When a leading edge of the sheet passed from the sheet feeder 301 reaches a nip of a conveying roller pair 313 as a most upstream pair of the image forming apparatus 300, the sheet is pulled out of the sheet feeder 301 by the conveying roller pair 313. When the sheet feeder 301 has fed and conveyed the number of sheets requested by the image forming apparatus 300, the sheet feeder 301 terminates the sheet-feeding operation. When the sheets of this group fed and conveyed are all pulled out by the image forming apparatus 300, the sheet feeder 301 terminates all operations, and enters the standby state for receiving the next sheet passing request from the image forming apparatus 300.

The console section 4 for the user to configure the operation settings of the image forming apparatus 300 and the reader scanner 303 for reading an image on a document are disposed at an upper location of the image forming apparatus 300. The image forming apparatus 300 sends a sheet passing request to the sheet feeder 301 as mentioned above, and pulls out sheets fed and conveyed according to the sheet passing request, from the sheet feeder 301. Each sheet pulled out is conveyed by conveying sections of the image forming apparatus 300.

A flapper 310 is used for switching the conveying path, and when a sheet being conveyed suffers from an abnormality, such as multi-feed and delay jam, the conveying path is switched to a conveying path for guiding the sheet to the escape tray 101, whereas when the sheet is being conveyed normally, the conveying path is switched to a conveying path for guiding the sheets to an image forming unit 307. When the sheet being conveyed suffers from an abnormality, the sheet suffering from the abnormality is discharged onto the escape tray 101 by the flapper 310. On the other hand, when the sheet is being conveyed normally, the sheet is guided to the image forming unit 307 by the flapper 310. Then, the leading edge of the sheet being conveyed in the sheet conveying direction is detected by an image reference sensor 305, the image forming unit 307 performs an image forming operation based on the received image data with reference to the leading edge as the starting point of image formation.

Note that although in the present embodiment, an escape conveying section 333 for discharging a sheet onto the escape tray 101 is provided within the image forming apparatus 300, this is not limitative, but the escape conveying section 333 may be provided within the sheet feeder 301.

A laser scanner unit 354 causes a laser beam emitted from a semiconductor laser and having a light amount controlled based on image data to be reflected by a polygon mirror the rotation of which is controlled by a scanner motor to form an image on a photosensitive drum 353. As a consequence, an electrostatic latent image is formed on the photosensitive drum 353. The electrostatic latent image on the photosensitive drum 353 is developed by a developing section 352 with toner supplied from a toner bottle 351. A toner image formed on the photosensitive drum 353 by development is transferred onto an intermediate transfer belt 355. The toner image transferred onto the intermediate transfer belt 355 is transferred onto a sheet at a secondary transfer position. A registration controller 306 is provided immediately before the secondary transfer position, and performs skew correction and conveyance control of the sheet immediately before being subjected to the transfer without stopping the sheet. Note that the conveyance control refers to control of conveyance of the sheet for fine adjustment of the leading edge position of the sheet to be aligned with the leading edge position of a toner image on the intermediate transfer belt 355.

The sheet subjected to the transfer is conveyed to a fixing section 308. The fixing section 308 melts and fixes toner on the sheet by applying heat and pressure onto the sheet. To continue image formation on the reverse side of the sheet, or when it is necessary to invert the sheet, the sheet on having the toner fixed thereon is conveyed to an inversion conveying section 309. On the other hand, to terminate image formation, the sheet is conveyed to the post-processing apparatus 304 downstream of the image forming apparatus 300.

The post-processing apparatus 304 is connected to the downstream side of the image forming apparatus 300, and executes post processing (such as folding, stapling, and punching) set by the user from the console section 4, on sheets having images formed thereon. Then, the sheets (sheet bundle) subjected to the post processing are sequentially output to one of discharge trays 360 as products to be provided to the user.

Figure 2:
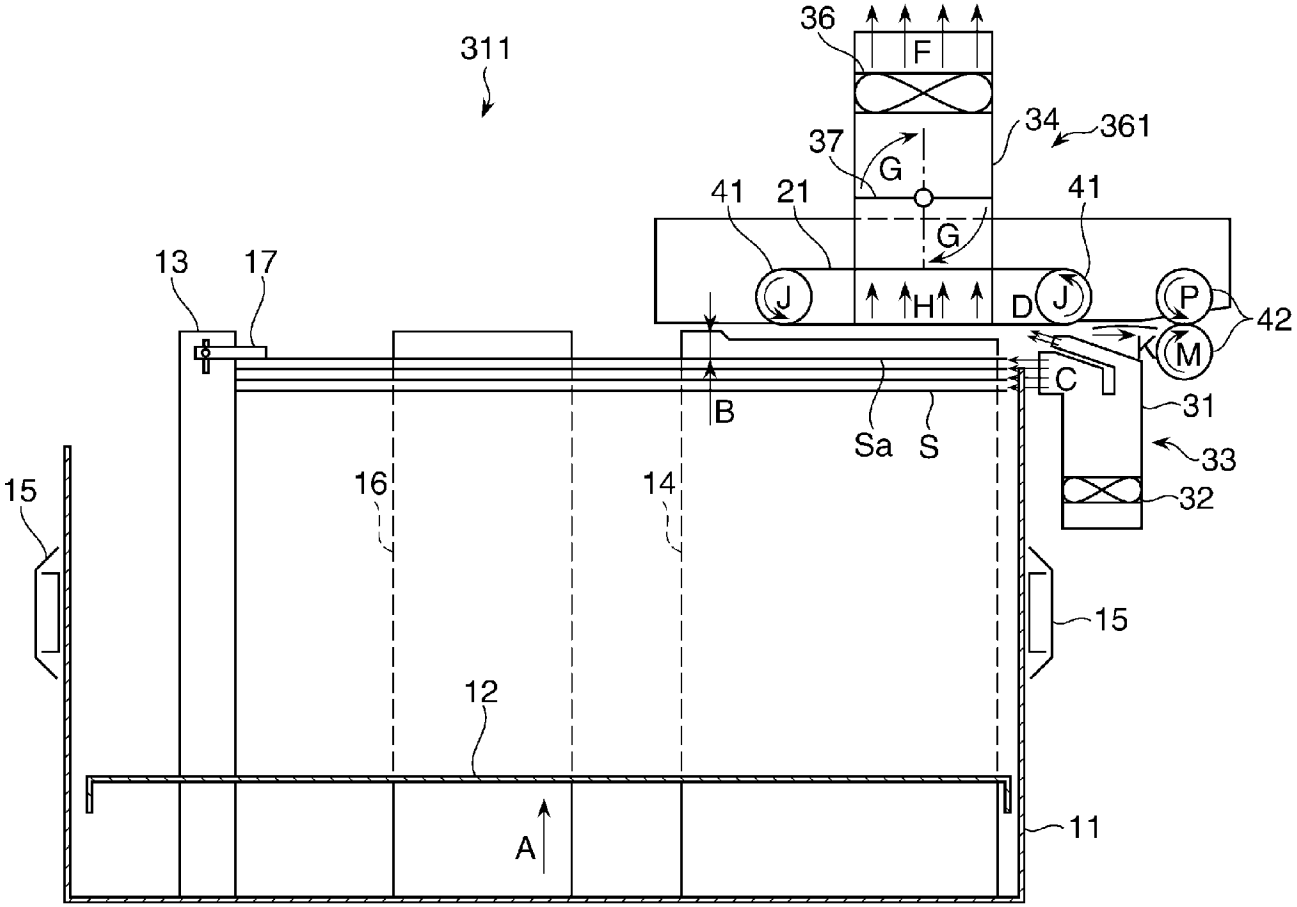
FIG. 2 is a cross-sectional view of an upper sheet feeding unit of the sheet feeder appearing in FIG. 1.

FIG. 2 is a cross-sectional view of the upper sheet feeding unit 311 of the sheet feeder 301.

As shown in FIG. 2, the sheet container 11 comprises a tray 12 on which a lot of sheets S are stacked, a trailing end restriction board 13 for restricting an upstream side (trailing ends) of the sheets S in the sheet conveying direction, lateral end restriction boards 14 and 16 for restricting sides of the sheets S in a direction (width direction) orthogonal to the sheet conveying direction, and a slide rail 15. The trailing end restriction board 13 has a sheet trailing end holder 17 provided at an upper portion thereof, for holding the trailing end of the sheet S.

When the user draws out the sheet container 11 to set sheets therein, and pushes the sheet container 11 back to a predetermined position, a motor, not shown, starts to be driven, and the tray 12 starts to be lifted up in a direction indicated by an arrow A in FIG. 2. Then, the tray 12 is stopped at a position where the distance between a top sheet Sa of the stacked sheets S and the suction conveyor belt 21 is equal to "B", and enters a state waiting for reception of a feed signal.

The suction conveyor unit 361 comprises the aforementioned suction conveyor belt 21, the belt driving rollers 41 for driving the suction conveyor belt 21, the aforementioned suction fan 36, a suction duct 34 for creating a negative pressure space by the suction fan 36 to cause a sheet S to be attracted to the suction conveyor belt 21, and a suction shutter 37 for adjusting the negative pressure applied to the suction duct 34. The sheet S is conveyed by a conveying force of the suction conveyor belt 21 toward a conveying roller pair 42 disposed at a location downstream in the sheet conveying direction.

An loosening air blower unit 33 comprises the aforementioned loosening blower 32, and a loosening & separation duct 31. An air stream generated by the loosening blower 32 is blown to a leading end of a sheet bundle through the loosening & separation duct 31 so as to loosen the sheet bundle and make sheets thereof separate from each other. More specifically, the loosening air blower unit 33 blows a loosening air stream for loosening the sheet bundle in a direction indicated by an arrow C in FIG. 2, and blows a separating air stream for separating the sheet Sa from the sheet bundle in a direction indicated by an arrow D in FIG. 2.

Figure 3A:
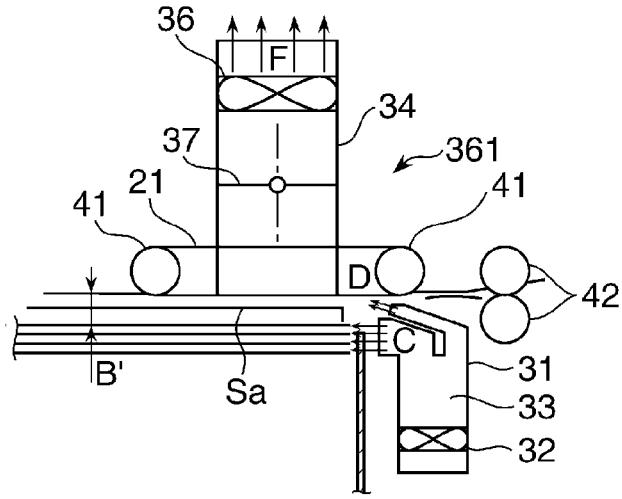
FIGS. 3A to 3C are diagrams useful in explaining how the upper sheet feeding unit shown in FIG. 2 feeds sheets.
Figure 3B:
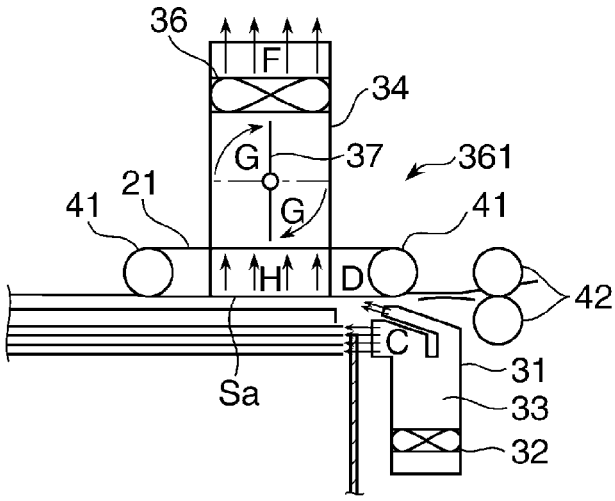
Figure 3C:
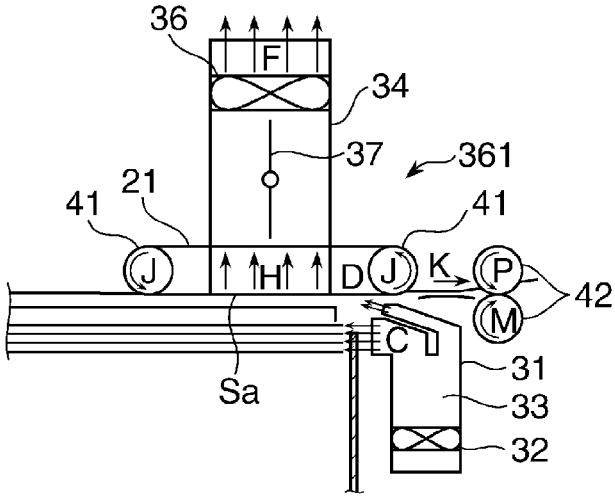

FIGS. 3A to 3C are diagrams useful in explaining how the upper sheet feeding unit 311 shown in FIG. 2 feeds sheets.

As described above with reference to FIG. 2, the feed signal is received when the tray 12 is in the state stopped at the position where the distance between the top sheet Sa and the suction conveyor belt 21 is equal to "B". Upon receipt of the feed signal, as shown in FIG. 3A, the suction fan 36 of the suction conveyor unit 361 is driven to blow air in a direction indicated by an arrow F in FIG. 3A. Similarly, the loosening blower 32 is driven to generate the loosening air stream blown in the direction indicated by the arrow C in FIG. 3A, and the separating air stream blown in the direction indicated by the arrow D in FIG. 3A, thus starting "air loosening".

When it is detected that the air loosening has caused the distance between the position of the surface of the top sheet Sa and the suction conveyor belt 21 of the suction conveyor unit 361 to become equal to "B'", then, as shown in FIG. 3B, the suction shutter 37 disposed in the suction duct 34 is opened by driving a solenoid, not shown. As a consequence, the top sheet Sa is attracted by suction air in a direction indicated by an arrow H in FIG. 3B.

As shown in FIG. 3C, as the belt driving rollers 41 are rotated in a direction indicated by an arrow J in FIG. 3C, the top sheet Sa which has been attracted is conveyed in a direction indicated by an arrow K in FIG. 3C by the conveying force of the suction conveyor belt 21. The top sheet Sa is finally conveyed to the next conveying path by rotating the conveying roller pair 42 in directions indicated by arrows M and P in FIG. 3C, respectively.

Figure 4:
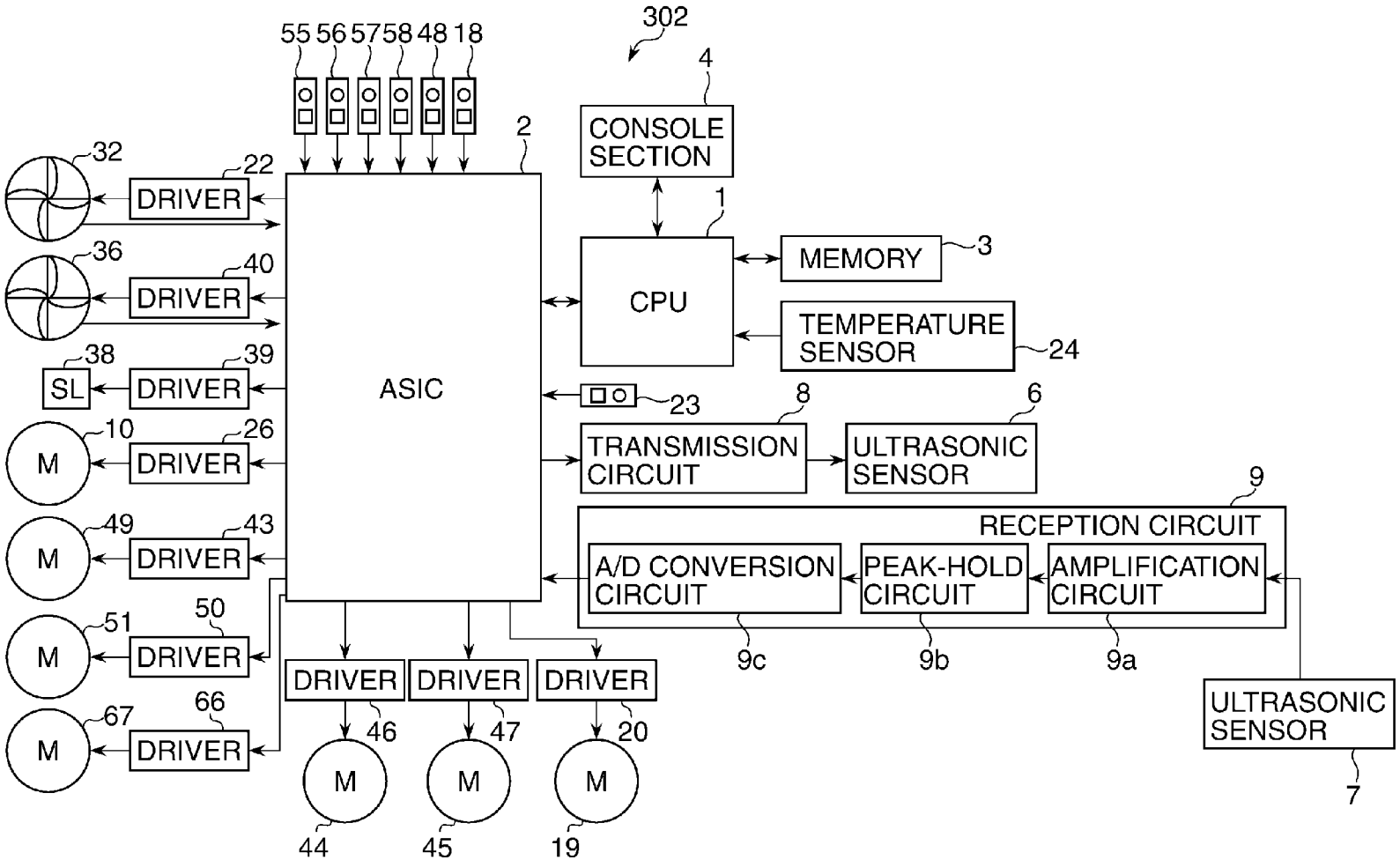
FIG. 4 is a block diagram of a controller that controls the sheet feeder appearing in FIG. 1 and associated components around the controller.

FIG. 4 is a block diagram of the controller 302 that controls the sheet feeder 301 appearing in FIG. 1 and associated components around the controller 302.

The controller 302 includes a CPU (central processing unit) 1 that controls the overall operation of the sheet feeder 301. Connected to the CPU 1 is a dedicated ASIC (application specific integrated circuit) 2 for driving various kinds of loads included in the sheet feeder 301, such as various motors and fans. Also connected to the CPU 1 are the console section 4 that enables the user to input sheet information of the sheet S, such as a size, a basis weight, and surface property, and a memory 3 for storing various data input from the console section 4, target values and PWM (pulse width modulation) values used for adjusting the fans, and so forth. Further, the temperature sensor 24 for detecting temperature in the sheet feeder 301 is also connected to the CPU 1.

Various sensors 18, 23, 48, and 55 to 58 are connected to the ASIC 2, and the ASIC 2 monitors outputs from the respective sensors.

The sensor 48 is a sheet container-opening/closing sensor for detecting the open/closed state of the sheet container 11.

The sensors 55 and 57 are a lower position detection sensor and an upper position detection sensor for detecting a lower position and an upper position of the tray 12 in the sheet container 11, respectively.

The sensor 18 is a paper surface detection sensor for detecting a top surface of the sheets S stacked on the tray 12.

The sensor 56 is a sheet detection sensor for detecting whether or not there is a bundle of sheets S on the tray 12.

The sensor 58 is a suction completion detection sensor for monitoring the state of negative pressure in the suction duct 34 when the sheet S is attracted to the suction conveyor belt 21 by the negative pressure generated by the suction fan 36 of the suction conveyor unit 361 to thereby detect that the sheet S is completely attracted to the suction conveyor belt 21.

The sensor 23 is a sheet detection sensor for detecting whether or not the sheet S is in the merged conveying passage section 319 (see FIG. 1).

Connected to the ASIC 2 are various drivers (drive circuits) 20, 22, 26, 39, 40, 43, 46, 47, 50, and 66.

The driver 22 sends a PWM signal output from the ASIC 2 to the loosening blower 32, and also supplies power thereto.

The driver 40 sends a PWM signal output from the ASIC 2 to the suction fan 36, and also supplies power thereto.

Rotational speed signals (FG) output from the loosening blower 32 and the suction fan 36 are input to the ASIC 2, and the ASIC 2 performs PWM control such that the loosening blower 32 and the suction fan 36 are rotated at respective target rotational speeds.

The driver 39 drives a suction solenoid (SL) 38 which opens and closes the suction shutter 37 in the suction duct 34 of the suction conveyor unit 361.

The driver 46 drives a sheet feeding motor 44 for rotating the belt driving rollers 41 of the suction conveyor unit 361.

The driver 47 drives a pull-out motor 45 for rotating the conveying roller pair 42.

The driver 20 drives a lifter motor 19 for lifting the tray 12 up and down.

The driver 26 drives a lower conveying motor 10 for rotating the conveying rollers of the lower conveying section 318.

The driver 43 drives an upper conveying motor 49 for rotating the conveying rollers of the upper conveying section 317.

The driver 50 drives a merged conveying passage motor 51 for rotating the conveying rollers of the merged conveying passage section 319.

The driver 66 drives an escape conveying motor 67 for rotating the conveying rollers of the escape conveying section 333.

Further connected to the ASIC 2 are a transmission circuit 8 for outputting a transmission signal to the ultrasonic sensor 6 as the transmitter unit, and a reception circuit 9 for inputting a signal received from the ultrasonic sensor 7 as the receiver unit. Note that a multi-feed detection sensor is formed by the ultrasonic sensor 6 as the transmitter unit and the ultrasonic sensor 7 as the receiver unit. The ultrasonic sensor 6 transmits ultrasonic waves according to a transmission signal.

The reception circuit 9 is formed by an amplification circuit 9*a* for amplifying the received signal input thereto, a peak-hold circuit 9*b* for holding a peak voltage of the amplified received signal, and an analog-to-digital conversion circuit 9*c* for converting an analog signal formed by the held peak voltage to a digital signal. An output from the reception circuit 9, i.e. a received signal (received data) converted from analog to digital is sent as data to the CPU 1 via the ASIC 2. The CPU 1 compares the received data and the data stored in the memory 3 to thereby determine whether or not multi-feed of the sheets has occurred.

Although in the present embodiment, the various kinds of loads included in the sheet feeder 301, such as various motors and fans, are indirectly controlled by the CPU 1 via the ASIC 2, this is not limitative, but the CPU 1 may directly control the various kinds of loads. Further, in the present embodiment, the console section 4 and the memory 3 are directly connected to the CPU 1 and controlled by the CPU 1, forming part of the arrangement of the sheet feeder 301. However, this is not limitative, but the console section 4 and the memory 3 may be part of the arrangement of the image forming apparatus 300, and the CPU 1 may use the console section 4 and the memory 3 via the image forming apparatus 300. Further, although in the present embodiment, the sheet information is input from the console section 4, this is not limitative, but the sheet information may be automatically recognized by a sheet information detection device (not shown) provided in the sheet feeder 301.

Figure 5:
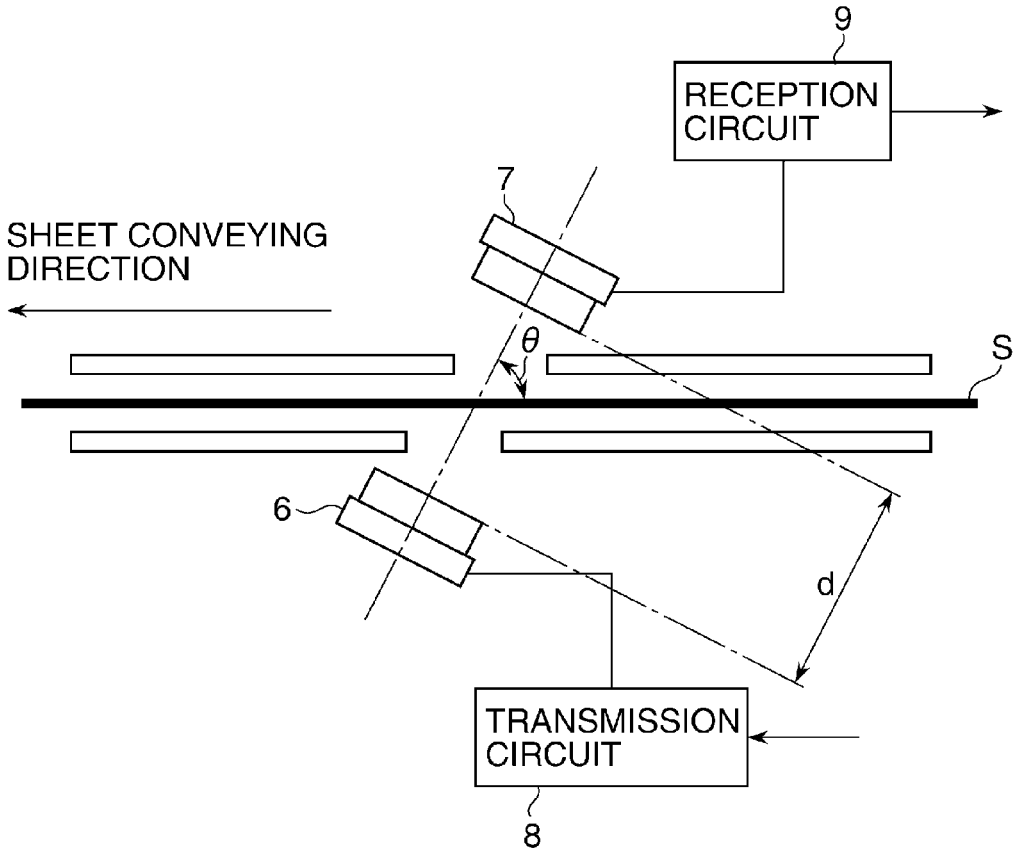
FIG. 5 is a diagram showing an example of a positional relationship of ultrasonic sensors forming a multi-feed detection sensor.

FIG. 5 is a diagram showing an example of a positional relationship of the ultrasonic sensors 6 and 7, forming the multi-feed detection sensor.

The ultrasonic sensors 6 and 7 are disposed in a manner opposed to each other across the sheet conveying path. The ultrasonic sensor 6 is a transmitter sensor which transmits ultrasonic waves as mentioned above, and is disposed at a location under the sheet conveying path. On the other hand, the ultrasonic sensor 7 is a receiver sensor which receives ultrasonic waves as mentioned above, and is disposed at a location above the sheet conveying path. The ultrasonic sensors 6 and 7 are disposed in a manner spaced from each other by a distance d (mm). Further, the ultrasonic sensors 6 and 7 are arranged in such a manner that an angle formed by a transmission axis between the sensors 6 and 7 (axis indicated by a dash-dot line) and the sheet S passing along the sheet conveying path is equal to θ (e.g. θ=45°). These sensors are arranged as above so as to prevent ultrasonic waves transmitted from the ultrasonic sensor 6 as the transmitter unit from being influenced by multiple reflection of the waves e.g. from the sheet S.

Figure 6A:
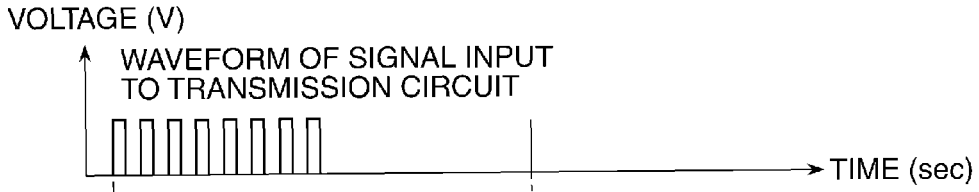
FIG. 6A is a diagram showing an input signal to a transmission circuit appearing in FIG. 5.
Figure 6B:
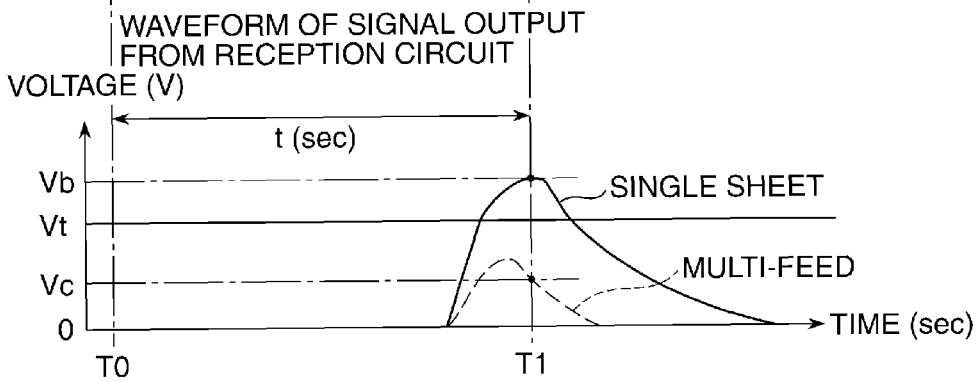
FIG. 6B is a diagram showing output signals from a reception circuit appearing in FIG. 5.

FIG. 6A is a diagram showing an input signal input to the transmission circuit 8 appearing in FIG. 5. FIG. 6B is a diagram showing output signals from the reception circuit 9 appearing in FIG. 5.

As shown in FIG. 6A, a pulse signal is input to the transmission circuit 8 for causing the same to generate burst waves of a frequency unique to the ultrasonic sensor 6 in use, which correspond to a predetermined number of pulses (in the illustrated example, eight pulses) of the input pulse signal.

Upon inputting of the above-mentioned pulse signal to the transmission circuit 8, the ultrasonic sensor 6 transmits ultrasonic waves, and the ultrasonic sensor 7 receives the transmitted ultrasonic waves, converts the received ultrasonic waves to an electric signal, and outputs the converted electric signal to the reception circuit 9. In FIG. 6B, a waveform indicated by a solid line indicates a waveform of an output signal from the reception circuit 9 when a single sheet S is being fed normally, and a waveform indicated by a broken line indicates a waveform of an output signal from the reception circuit 9 when sheets S are being multi-fed. Note that the waveform of the output signal from the reception circuit 9 is a waveform obtained by receiving ultrasonic waves transmitted from the ultrasonic sensor 6 as the transmitter unit by the ultrasonic sensor 7 as the receiver unit, thereafter amplifying the ultrasonic waves with a predetermined gain, and holding the peak level of the ultrasonic waves.

When the ultrasonic waves from the ultrasonic sensor 6 are transmitted through sheets S being multi-fed, the ultrasonic waves undergo a higher degree of attenuation by the sheets S than when the ultrasonic waves are transmitted through a sheet S not being multi-fed. Therefore, if sheets S are being multi-fed, the voltage level of the waveform holding the peak level generally decreases. Here, it is assumed that a peak level of the waveform of the received signal is held at a timing T1 after lapse of a predetermined time t (sec) from a timing T0 at which the pulse signal starts to be input to the transmission circuit 8, and is subjected to analog-to-digital conversion, whereafter the digital signal is detected as a voltage value (ultrasonic level). That is, the reception circuit 9 functions as a first detection unit configured to detect the level of the received ultrasonic waves. The output voltage from the reception circuit 9 at the timing T1 is at Vb(V) when a single sheet S is being fed normally, whereas the output voltage is at Vc(V) when sheets S are being multi-fed. Further, a voltage value Vt satisfying $Vc \leq Vt < Vb$ is set to a threshold voltage (predetermined threshold value) used for determining whether a single sheet S is being fed normally or sheets S are being multi-fed, and the threshold value Vt and an output value from the reception circuit 9 after lapse of the predetermined time t from the start of inputting the pulse signal to the transmission circuit 8 are compared with each other to thereby determine whether or not multi-feed of sheets has occurred.

Figure 7:
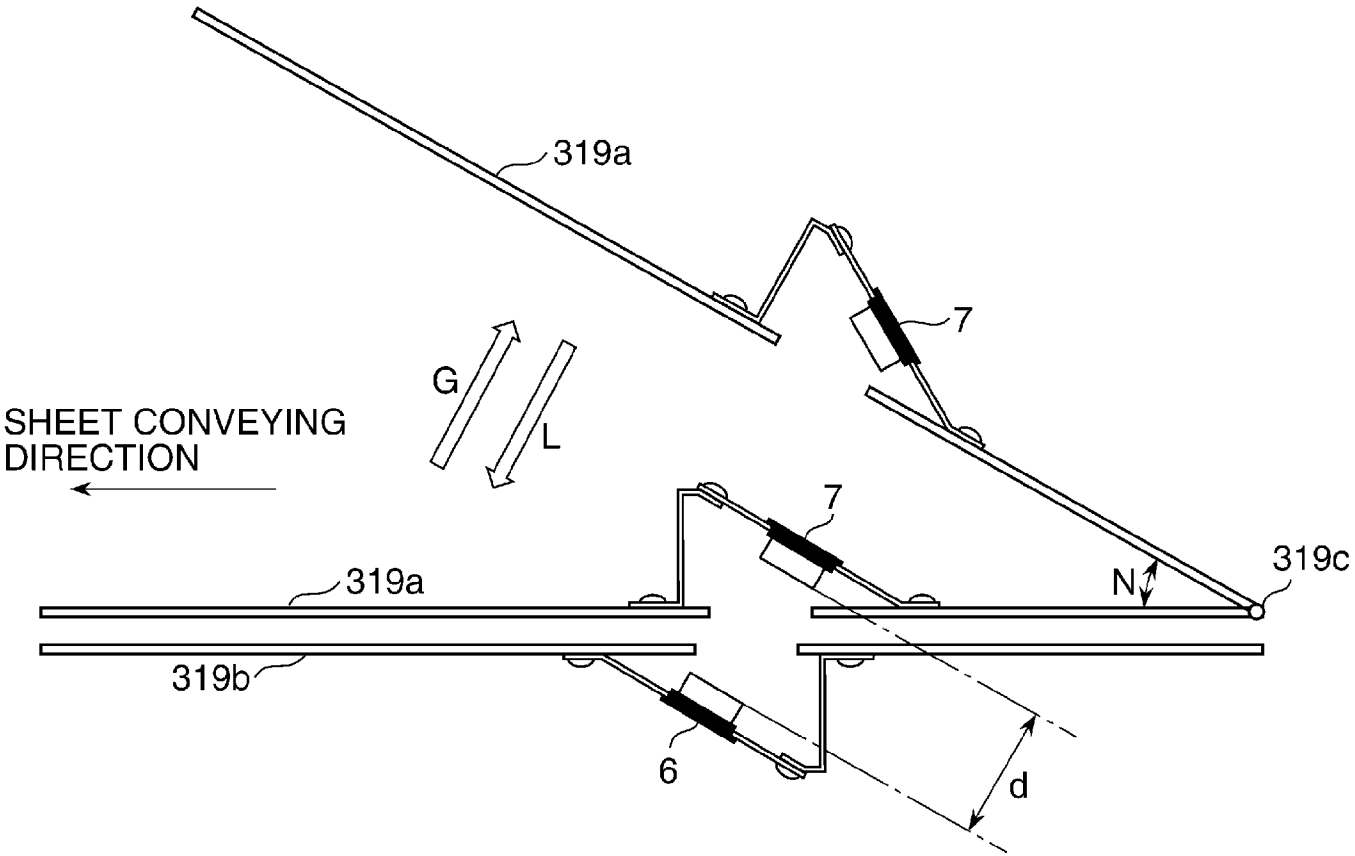
FIG. 7 is a diagram showing the arrangement of components at and around a location where the multi-feed detection sensor is disposed.

FIG. 7 is a diagram showing the arrangement of components at and around a location where the multi-feed detection sensor is disposed, in the merged conveying passage section 319 provided in the sheet feeder 301, and explains opening and closing operations of the merged conveying passage section 319 when performing jammed paper removal.

As shown in FIG. 7, the merged conveying passage section 319 includes an upper conveying path guide 319*a* and a lower conveying path guide 319*b*. The upper conveying path guide 319*a* is provided with the ultrasonic sensor 7 as the receiver unit, and the lower conveying path guide 319*b* is provided with the ultrasonic sensor 6 as the transmitter unit. Usually, the upper conveying path guide 319*a* and the lower conveying path guide 319*b* are opposed to each other in a manner spaced from each other by a predetermined distance. As mentioned hereinabove, the ultrasonic sensors 6 and 7 are spaced from each other by the distance d which is a predetermined value. In this state, if a paper jam or the like occurs at any place within the sheet feeder 301, causing a sheet to remain in the merged conveying passage section 319, a procedure for removing the jammed sheet is displayed on the console section 4. Following the procedure displayed on the display, the user lifts up the upper conveying path guide 319*a* in a direction indicated by an arrow G in FIG. 7 using a lever, not shown. The upper conveying path guide 319*a* can be opened up in a manner pivoting about a supporting point 319*c* to a position which forms an angle N with the original position. That is, the ultrasonic sensor 6 as the transmitter unit and the ultrasonic sensor 7 as the receiver unit are configured to be further spaced from each other according to the movement of the upper conveying path guide 319*a*. After the jammed sheet is removed, the user lifts down the upper conveying path guide 319*a* in a direction indicated by an arrow L in FIG. 7, causing the upper conveying path guide 319*a* to return to the normal condition. At this time, the distance between the ultrasonic sensors 6 and 7 sometimes increases or decreases from the predetermined value d due to a mechanical variation. Note that the ultrasonic sensors 6 and 7 may be arranged such that the ultrasonic sensor 6 is disposed on a side of the upper conveying path guide 319*a*, and the ultrasonic sensor 7 is disposed on a side of the lower conveying path guide 319*b*.

Figure 8A:
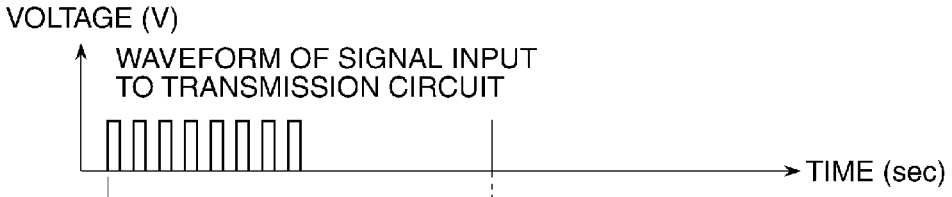
FIG. 8A is a diagram showing a signal waveform of a pulse signal input to the transmission circuit.
Figure 8B:
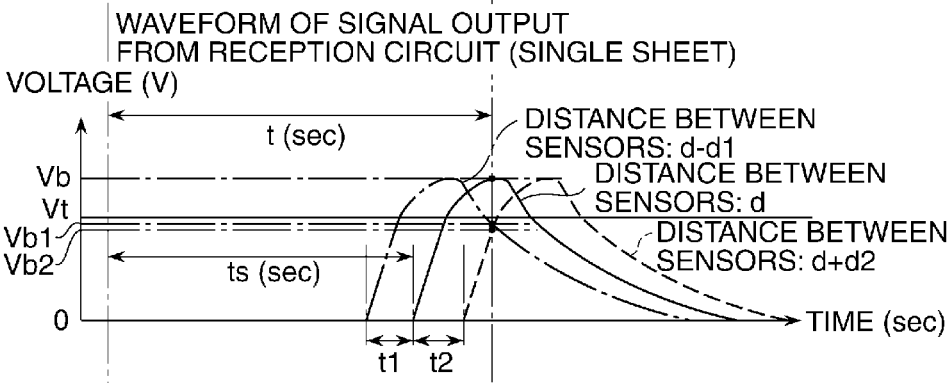
FIG. 8B is a diagram showing an output signal from the reception circuit in a state in which multi-feed has not occurred.
Figure 8C:
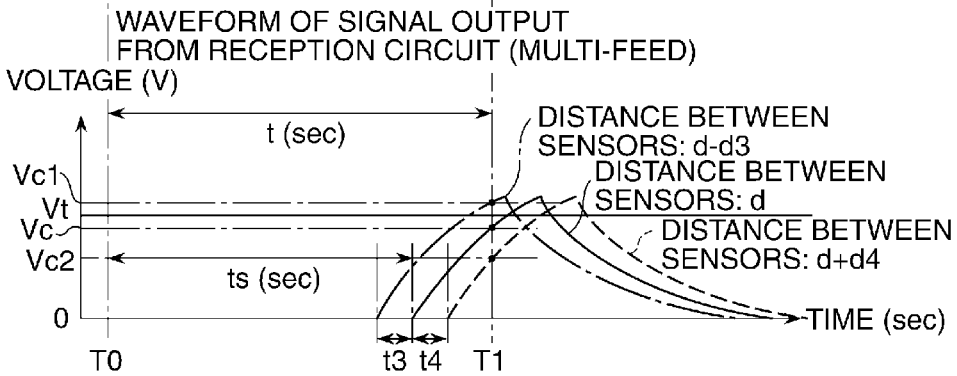
FIG. 8C is a diagram showing an output signal from the reception circuit in a state in which multi-feed has occurred.

FIGS. 8A to 8C are diagrams showing the same pulse signal as shown in FIG. 6A, which is input to the transmission circuit 8, and output signals from the reception circuit 9 during the normal state and the abnormal state, in which FIG. 8A corresponds to FIG. 6A, and FIGS. 8B and 8C correspond to FIG. 6B. However, FIGS. 8A to 8C show a case where the distance between the ultrasonic sensors 6 and 7 is increased or reduced from the predetermined value d with respect to FIGS. 6A and 6B.

FIG. 8B shows the output signals from the reception circuit 9 in respective cases where the distance between the ultrasonic sensors 6 and 7 is equal to the predetermined distance d (mm), d−d1 (mm), and d+d2 (mm) when a single sheet S is being fed normally.

In FIG. 8B, a solid line indicates the same waveform as indicated by the solid line in FIG. 6B. In FIG. 8B, a dash-dot line indicates an output waveform when the distance between the ultrasonic sensors 6 and 7 is reduced from the predetermined value d by a value of d1, and a broken line indicates an output waveform when the distance between the ultrasonic sensors 6 and 7 is increased from the predetermined value d by a value of d2.

The output voltage at the timing T1 is at Vb(V) when the distance between the ultrasonic sensors 6 and 7 is equal to the predetermined value d, which higher than the threshold voltage Vt(V). On the other hand, the output voltage is at Vb1(V) when the distance between the ultrasonic sensors 6 and 7 is reduced from the predetermined value d by the value of d1, and is at Vb2(V) when the distance between the ultrasonic sensors 6 and 7 is increased by the value of d2 (mm). That is, the output voltages Vb1 and Vb2 are lower than the threshold voltage Vt(V). As a result, although a single sheet S is being fed normally, multi-feed is erroneously detected. This is caused by an increase or decrease in time required for the ultrasonic wave from the ultrasonic sensor 6 as the transmitter unit to reach the ultrasonic sensor 7 as the receiver unit, occurring in accordance with the increase or decrease in the distance between the ultrasonic sensors 6 and 7 from the predetermined value d. To cope with cases where the increase or decrease in the distance between the sensors is so large as to cause erroneous detection of a multi-feed from a single sheet being fed, as mentioned above, it is necessary to correct the threshold voltage according to the distance between the sensors.

FIG. 8C shows output signals from the reception circuit 9 in respective cases where the distance between the ultrasonic sensors 6 and 7 is equal to the predetermined distance d (mm), d−d3 (mm), and d+d4 (mm) when sheets S are being multi-fed.

In FIG. 8C, a solid line indicates an output waveform when the distance between the ultrasonic sensors 6 and 7 is equal to the predetermined value d, which corresponds to the waveform indicated by the broken line in FIG. 6B (though different in shape). In FIG. 8C, a dash-dot line indicates an output waveform when the distance between the ultrasonic sensors 6 and 7 is reduced from the predetermined value d by a value of d3, and a broken line indicates an output waveform when the distance between the ultrasonic sensors 6 and 7 is increased from the predetermined value d by a value of d4.

The output voltage at the timing T1 is at Vc(V) when the distance between the ultrasonic sensors 6 and 7 is equal to the predetermined value d, and is at Vc2(V) when the distance between the ultrasonic sensors 6 and 7 is increased from the predetermined value d by a value of d4. That is, the output voltages Vc and Vc2 are lower than the threshold voltage Vt(V). On the other hand, the output voltage is at Vc1(V) when the distance between the ultrasonic sensors 6 and 7 is reduced from the predetermined value d by the value of d3, and is higher than the threshold voltage Vt(V). As a result, although the sheets S are being multi-fed, it is erroneously detected that a single sheet S is being fed. This is caused by a decrease in time required for the ultrasonic wave from the ultrasonic sensor 6 as the transmitter unit to reach the ultrasonic sensor 7 as the receiver unit, occurring with the decrease in the distance between the ultrasonic sensors 6 and 7 from the predetermined value d. To cope with cases where the decrease in the distance between the sensors is so large as to cause erroneous detection that a single sheet is being fed normally even though a plurality of sheets are being conveyed, it is necessary to correct the threshold voltage according to the distance between the sensors.

Further, in FIG. 8B, in the case where the distance between the ultrasonic sensors 6 and 7 is equal to the predetermined value d, the output waveform starts to rise a predetermined time period ts (sec) later than the time T0 at which the pulse signal starts to be input to the transmission circuit 8. On the other hand, in the case where the distance between the ultrasonic sensors 6 and 7 is reduced from the predetermined value d by the value of d1, the output waveform starts to rise a time period t1 (sec) earlier than the predetermined time. Similarly, in the case where the distance between the ultrasonic sensors 6 and 7 is increased from the predetermined value d by the value of d2, the output waveform starts to rise a time period t2 (sec) later than the predetermined time ts. These time periods t1 and t2 correspond to the decrease and increase in the time required for the ultrasonic wave to reach the ultrasonic sensor 7, respectively. The reduced amount d1 (mm) of the distance between the sensors is determined by multiplying the time period t1 (sec) by the sonic speed (mm/sec). Similarly, the increased amount d2 (mm) of the distance between the sensors is determined by multiplying the time period t2 (sec) by the sonic speed (mm/sec). The time periods ts, ts−t1, ts+t2, and the like are determined by monitoring the output voltage output from the reception circuit 9, and measuring a time period elapsed after the pulse signal starts to be input to the transmission circuit 8 until the output voltage rises from 0(V) exhibited before receiving the transmitted ultrasonic wave to a predetermined voltage close to 0(V).

The time period t3 and the distance d3, and the time period t4 and the distance d4 in FIG. 8C, each have a similar relationship to the above-described relationship, and hence description thereof is omitted.

As described above, in the present embodiment, to prevent the accuracy of multi-feed detection from being reduced due to a change in the distance between the ultrasonic sensors 6 and 7, the threshold voltage used for determination of whether a single sheet S is being fed normally or sheets S are being multi-fed is corrected according to the detected distance between the ultrasonic sensors 6 and 7.

FIGS. 9A to 9C are diagrams each showing a relationship between a distance between the ultrasonic sensors 6 and 7 and a threshold voltage used for multi-feed determination.

In the present embodiment, a design value of the distance d between the ultrasonic sensors 6 and 7 is set to 20 mm, and the distance between the ultrasonic sensors 6 and 7 is within a range of 20 mm±1 mm even with a mechanical variation taken into account. The detected distance between the sensors is handled, by ignoring the second and subsequent decimal places. Further, the sonic speed of the ultrasonic wave transmitted from the ultrasonic sensor 6 is increased or reduced according to the temperature, and a time required for the ultrasonic wave to reach the ultrasonic sensor 7 as the receiver unit is also accordingly increased or reduced. As a result, the voltage value output from the transmission circuit 8 at the timing T1 after lapse of the predetermined time period t from the timing T0 at which the pulse signal started to be input to the transmission circuit 8 is also increased or reduced, and it is necessary to correct the threshold voltage also according to environmental temperature of locations where the ultrasonic sensors 6 and 7 are disposed. Therefore, also after the distance between the sensors has been detected, the environmental temperature of the locations where the ultrasonic sensors 6 and 7 are disposed is detected at the timing of execution of multi-feed detection. In the present embodiment, the sheet feeder 301 is designed such that the temperature in the sheet feeder 301 falls within a range of 0° C. to 60° C., and hence the threshold voltage depends not only on the distance between the sensors, but also on the temperature in the sheet feeder 301 within the range of 0° C. to 60° C.

FIG. 9A shows an example of the relationship between the distance between the sensors and the threshold voltage set in association therewith in a case where the temperature in the sheet feeder 301 is 25° C., and values of the threshold voltage associated with respective values of the distance between the sensors in this case where the temperature in the sheet feeder 301 is 25° C. are default settings.

FIGS. 9B and 9C show examples of the relationship between the distance between the sensors and the threshold voltage set in association therewith in respective cases where the temperature in the sheet feeder 301 is 0° C. and 60° C.

Although FIGS. 9A to 9C show the relationship between the distance between the sensors and the threshold voltage set in association therewith in the respective cases where the temperature in the sheet feeder 301 is 0° C., 25° C., and 60° C., in actuality, the temperature in the sheet feeder 301 is more finely set within the range of 0° C. to 60° C.

Hereafter, the relationship between the distance between the sensors and the threshold voltage set in association therewith will be described using the example shown in FIG. 9A, in which the temperature of the apparatus is 25° C., as a representative.

As shown in FIG. 9A, the threshold voltage used for the multi-feed determination according to the detected distance between the sensors is set by differentiating between coated paper having a basis weight of less than 80 gsm (gram per square meter), coated paper having a basis weight of not less than 80 gsm and less than 128 gsm, and the other types of paper. The coated paper having a basis weight of less than 80 gsm and the coated paper having a basis weight of not less than 80 gsm and less than 128 gsm have characteristics that attenuation of ultrasonic waves is small even when sheets are multi-fed, compared with the other types of paper, and there is little difference in attenuation of ultrasonic waves between the case where the sheets are multi-fed and the case where a single sheet is being fed normally. Due to the characteristics, the increase or decrease in the time required for ultrasonic waves to reach the ultrasonic sensor 7, caused by a change in the distance between the sensors, affects the voltage value output from the reception circuit 9 at the timing T1, and hence the threshold voltage is corrected according to the distance between the sensors. On the other hand, the other types of paper are large in attenuation of ultrasonic waves when the sheets are multi-fed, and hence the increase or decrease in the time required for ultrasonic waves to reach the ultrasonic sensor 7, caused by a change in the distance between the sensors, does not affect the voltage value output from the reception circuit 9 at the timing T1. Therefore, the threshold voltage is not corrected.

A further description will be given of the coated paper having a basis weight of less than 80 gsm as a representative example.

When the detected distance between the sensors is within a range of 20.0 mm±0.2 mm, the threshold voltage is set to 300 mV. When the detected distance between the sensors is within a range of 20.3 mm to 20.5 mm, the distance between the sensors is increased. This delays time at which the transmitted ultrasonic wave reaches the ultrasonic sensor 7 as the receiver unit, so that the voltage value output from the reception circuit 9 at the timing T1 is reduced, and hence the threshold voltage is set to 290 mV. For the same reason, when the detected distance between the sensors is within 20.6 mm to 20.8 mm, the threshold voltage is set to 280 mV, and when the detected distance between the sensors is not smaller than 20.9 mm, the threshold voltage is set to 270 mV. When the detected distance between the sensors is within a range of 19.5 mm to 19.7 mm, the distance between the sensors is reduced. This advances time at which the transmitted ultrasonic wave reaches the ultrasonic sensor 7 as the receiver unit, so that the voltage value output from the reception circuit 9 at the timing T1 is increased, and hence the threshold voltage is set to 310 mV. For the same reason, when the detected distance between the sensors is within a range of 19.2 mm to 19.4 mm, the threshold voltage is set to 320 mV, and when the detected distance between the sensors is not larger than 19.1 mm, the threshold voltage is set to 330 mV.

Figure 10A:
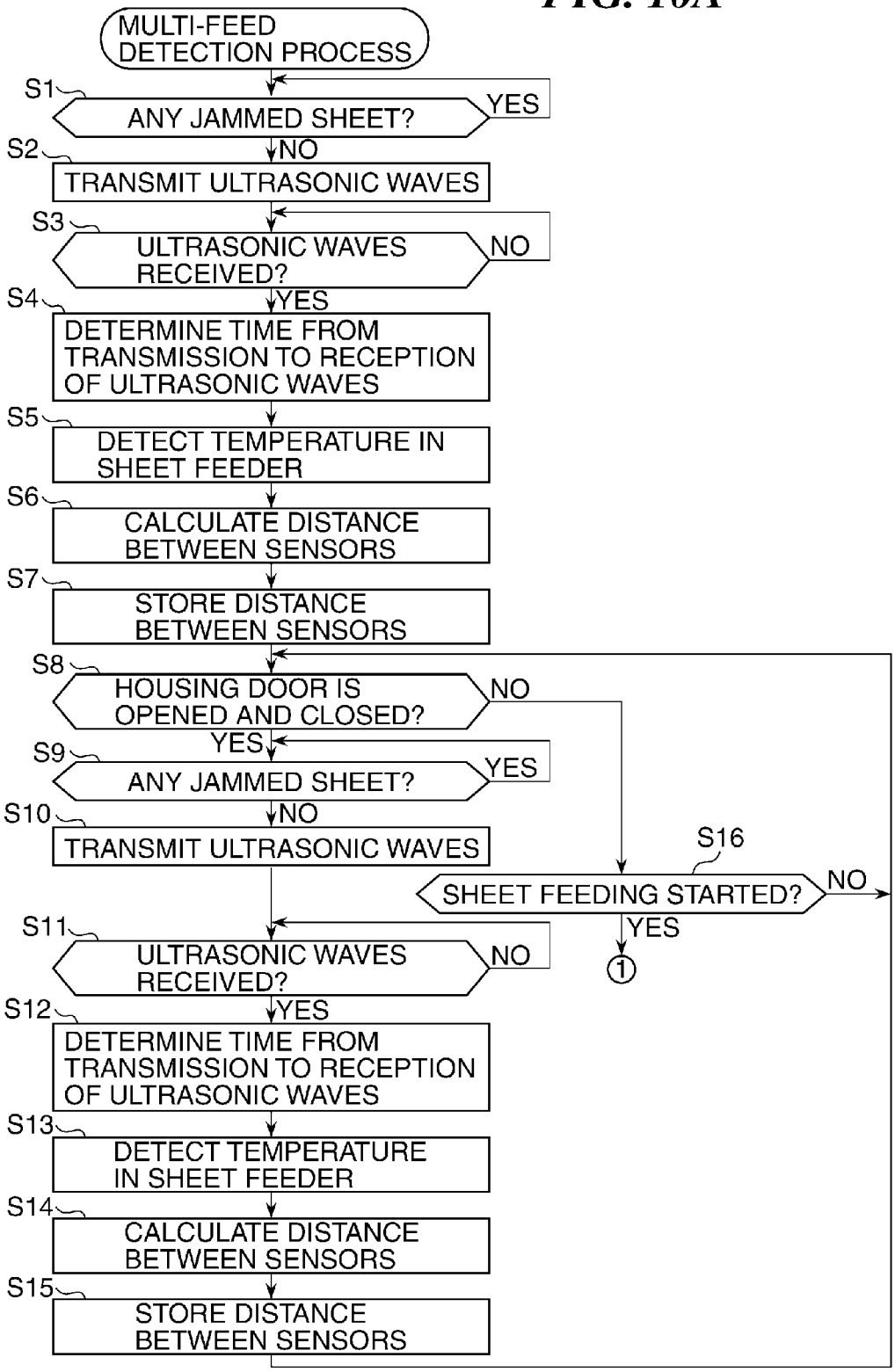
FIG. 10A is a flowchart of a multi-feed detection process executed by a CPU.
Figure 10B:
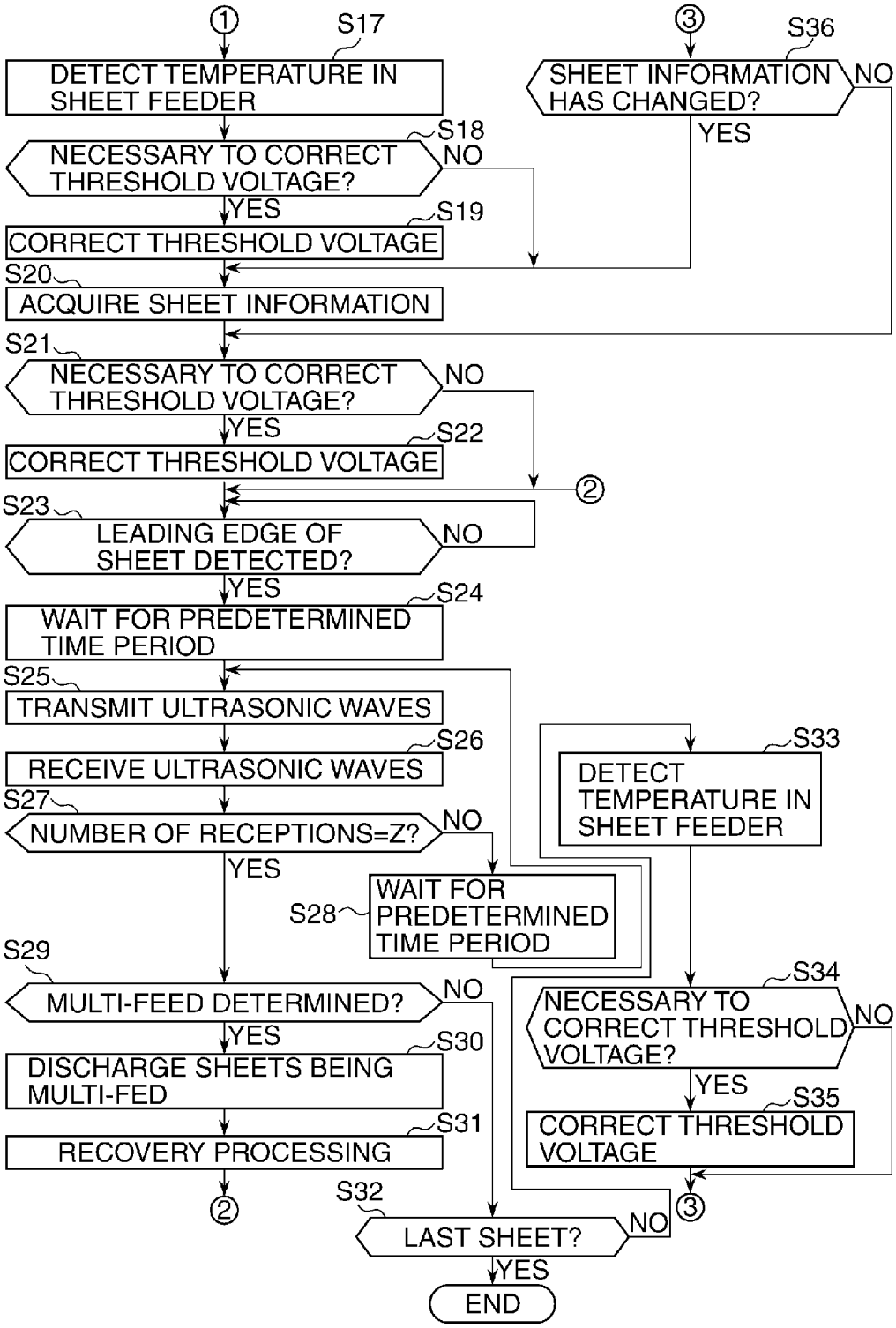
FIG. 10B is a continuation of FIG. 10A.

FIGS. 10A and 10B are a flowchart of a multi-feed detection process executed by the sheet feeder 301, and more particularly by the CPU 1. The present multi-feed detection process is started when power supply to the sheet feeder 301 is started.

First, the CPU 1 determines whether or not there is any jammed sheet between the ultrasonic sensor 6 as the transmitter unit and the ultrasonic sensor 7 as the receiver unit (step S1). This determination is performed based on an output from a reflection type sensor (not shown) disposed on the merged conveying passage section 319. If it is determined in the step S1 that there is a jammed sheet, the CPU 1 continues to monitor the output from the reflection type sensor until the jammed sheet is removed. On the other hand, if there is no jammed sheet, the CPU 1 inputs the pulse signal shown in FIG. 6A to the transmission circuit 8 to thereby cause the ultrasonic sensor 6 as the transmitter unit to transmit ultrasonic waves (step S2).

Next, the CPU 1 determines whether or not the transmitted ultrasonic waves have been received by the ultrasonic sensor 7 by monitoring the output from the ultrasonic sensor 7 as the receiver unit (step S3). When the voltage output from the reception circuit 9 rises from 0(V) up to a predetermined voltage close to 0(V), the CPU 1 determines that the transmitted ultrasonic waves have been received by the ultrasonic sensor 7. If it is determined in the step S3 that the transmitted ultrasonic waves have not been received by the ultrasonic sensor 7, the CPU 1 continues to monitor the output from the ultrasonic sensor 7 as the receiver unit until the transmitted ultrasonic waves are received. On the other hand, when the transmitted ultrasonic waves have been received by the ultrasonic sensor 7, the CPU 1 (measurement unit) determines a time period between transmission and reception of the ultrasonic waves (step S4).

Next, the CPU 1 detects the temperature in the sheet feeder 301 at the time based on the output from the temperature sensor 24 (step S5). Then, the CPU 1 (second detection unit) multiplies the elapsed time determined in the step S4 by the sonic speed calculated from the temperature in the sheet feeder 301 detected in the step S5 to thereby calculate the distance between the sensors at the time when the power is turned on (predetermined timing) (step S6). Further, the CPU 1 stores the calculated distance between the sensors in the memory 3 (step S7). The distance between the sensors is thus calculated at the time when the image forming apparatus is powered on, assuming a case where the operation of opening and closing the merged conveying passage section 319, which can increase or decrease the distance between the sensors, is performed during power-off of the image forming apparatus.

Next, the CPU 1 determines whether or not a housing door (not shown) of the merged conveying passage section 319 has been opened and closed based on an output from a photo interrupter (not shown) (step S8). Whether or not the housing door of the merged conveying passage section 319 has been opened and closed is thus determined because the operation of opening and closing the housing door of the merged conveying passage section 319 by the user can change the distance between the ultrasonic sensors 6 and 7. If it is determined in the step S8 that the housing door has not been opened and closed, the CPU 1 proceeds to a step S16, wherein the CPU 1 determines whether a feed signal for starting feed of sheets is output to the sheet feeder 301, and until the answer to this question becomes affirmative, monitoring of the housing door (step S8) and monitoring for the feed signal (step S16) are continued. On the other hand, if the housing door has been opened and closed (after accessing the vicinity of the transmitter unit and the receiver unit), there is a possibility that the distance between the ultrasonic sensors 6 and 7 has been changed, and hence the CPU 1 calculates the distance between the sensors again. More specifically, the CPU 1 executes the same processes as the steps S1 to S6 (steps S9 to S14). The distance between the sensors thus calculated is stored in the memory 3 similarly to the step S7 (step S15). Then, the CPU 1 returns to the step S8.

If it is determined in the step S16 that the feed signal for starting feed of sheets has been output to the sheet feeder 301, the CPU 1 proceeds to a step S17 in FIG. 10B. In the step S17, the CPU 1 detects the temperature in the sheet feeder 301 at the start of feeding sheets using the temperature sensor 24 similarly to the step S5. Then, the CPU 1 determines whether or not it is necessary to correct the threshold voltage for use in multi-feed determination according to a change in the temperature in the sheet feeder 301 (step S18). More specifically, if the temperature in the sheet feeder 301 detected in the step S17 is e.g. 25° C., the CPU 1 determines that it is not necessary to correct the threshold voltage for use in multi-feed determination according to a change in the temperature in the sheet feeder 301, and proceeds to a step S20. On the other hand, if the temperature in the apparatus detected in the step S17 has changed from 25° C. by a predetermined or larger degree, the CPU 1 proceeds to a step S19. In the step S19, the CPU 1 corrects (changes) the threshold voltage to a value associated with the value of the temperature in the sheet feeder 301 detected in the step S17 and the latest value of the distance between the sensors detected in the step S6 or S14.

In the step S20, the CPU 1 acquires the sheet information (e.g. surface property information and basis weight information) of sheets in a sheet container from which sheets are fed. The sheet information acquired in this step may be not only the sheet information input from the console section 4 and stored in the memory 3, but also the sheet information automatically recognized by a sheet information detection device, not shown, provided in the sheet feeder 301.

Next, the CPU 1 determines whether or not it is necessary to correct the threshold voltage for use in multi-feed determination in accordance with a change in the distance between the sensors or a change of the sheet information (step S21). More specifically, the CPU 1 determines, based on the latest value of the distance between the sensors detected in the step S6 or S14 and the sheet information (e.g. surface property information and basis weight information) acquired in the step S20, whether or not to correct the threshold voltage from the value set for the case where the distance between the sensors is 20 mm. If it is determined in the step S21 that it is not necessary to correct the threshold voltage, the CPU 1 proceeds to a step S23. On the other hand, if it is necessary to correct the threshold voltage, the CPU 1 proceeds to a step S22. In the step S22, the CPU 1 determines a value of the threshold voltage based on the latest value of the distance between the sensors and the acquired sheet information, and corrects the threshold voltage to the determined value. As described above with reference to FIGS. 9A to 9C, when sheets of a type large in attenuation of ultrasonic waves in case of multi-feed are being conveyed, the increase or decrease in time required for the ultrasonic waves to reach the ultrasonic sensor 7, caused by a change in the distance between the sensors, does not significantly affect the voltage value output from the reception circuit 9. Therefore, in this case, the CPU 1 sets the threshold voltage without referring to the distance between the sensors, and it is not necessary to correct the threshold voltage. Therefore, the CPU 1 proceeds from the step S21 to the step S23 without executing the step S22.

In the step S23, the CPU 1 monitors for the leading edge of the sheet S which has been fed and conveyed, using the sheet detection sensor 23, and when the leading edge is detected, the CPU 1 waits for a predetermined time period (step S24), and then, proceeds to a step S25. In the step S25, the CPU 1 transmits ultrasonic waves from the ultrasonic sensor 6 as the transmitter unit according to the same process as the step S2. In a subsequent step S26, the CPU 1 receives the transmitted ultrasonic waves by the ultrasonic sensor 7 as the receiver unit. Then, the CPU 1 determines in a step S27 whether the number of receptions of ultrasonic waves by the ultrasonic sensor 7 as the receiver unit reaches a predetermined number Z, and until the number of receptions of ultrasonic waves reaches the predetermined number Z, repeats waiting for a predetermined time period in a step S28, and transmitting ultrasonic waves in the step S25, and receiving ultrasonic waves in the step S26. When the number of receptions of ultrasonic waves by the ultrasonic sensor 7 as the receiver unit reaches the predetermined number Z, the CPU 1 determines, based on data items acquired by reception performed the Z times, whether or not sheets S are being multi-fed (step S29). In this step, the CPU 1 determines that multi-feed has occurred if it is determined that the output voltage is not higher than the threshold voltage, as to a predetermined number X or more of data items of all the data items acquired by reception performed the Z times, whereas if not, the CPU 1 determines that multi-feed has not occurred.

If it is determined in the step S29 that sheets S are being multi-fed, the CPU 1 switches the conveying path by the flapper 310 to thereby discharge the sheets S being multi-fed onto the escape tray 101 (step S30). After the sheets S are discharged onto the escape tray 101, the CPU 1 performs recovery processing for feeding a sheet in place of the sheets discharged due to multi-feed (step S31), and then returns to the step S23.

On the other hand, if it is determined in the step S29 that sheets S are not being multi-fed, the CPU 1 determines whether or not the sheet S is the last one for the sheet feeding job (step S32). If it is determined in the step S32 that the sheet is the last one, the CPU 1 terminates the present multi-feed detection process so as to terminate the sheet feeding operation by the sheet feeder 301. On the other hand, if the sheet is not the last one, the CPU 1 detects the temperature in the sheet feeder 301 so as to monitor for a change in the temperature in the sheet feeder 301 during the feed of this sheet (step S33).

Next, the CPU 1 determines whether or not it is necessary to correct the threshold voltage for use in multi-feed determination accordance to a change in the temperature in the sheet feeder 301, detected in the step S33 (step S34). Details of processing in the step S34 and a subsequent step S35 are the same as those in the steps S18 and S19, and hence description thereof is omitted.

Next, the CPU 1 proceeds to a step S36, wherein if there is a change in the sheet information (e.g. surface property information and basis weight information) of a sheet to be fed next, the CPU 1 proceeds to the step S20 to acquire the sheet information again. On the other hand, if there is no change in the sheet information, the CPU 1 proceeds to the step S21, and continues the multi-feed detection process on the next sheet. Note that image formation is performed on a sheet which is not determined to be being multi-fed.

Although in the present embodiment, the present multi-feed detection process is executed by the sheet feeder 301, this is not limitative, but the multi-feed detection process may be executed by the image forming apparatus 300, or further alternatively, may be executed by the reader scanner 303.

As described above, in the present embodiment, the distance between the sensors is detected, when the sheet feeder 301 is powered on and when the housing door of the merged conveying passage section 319 is opened and closed before the start of feeding sheets, and the threshold voltage for use in multi-feed determination is corrected according to the detected distance between the sensors. Therefore, even when the distance between the sensors has changed, it is possible to accurately detect multi-feed of sheets.

Next, a description will be given of a second embodiment of the present invention. The sheet feeder according to the present embodiment differs from the sheet feeder according to the first embodiment only in part of the multi-feed detection process. Therefore, the image forming system including the sheet feeder according to the present embodiment has the same hardware configuration of the image forming system 1000 according to the first embodiment, i.e. the hardware configuration shown in FIGS. 1 to 5, and hence description of the components is omitted by denoting them using the same reference numerals.

To reduce erroneous detection of multi-feed due to a change in the distance between the ultrasonic sensors 6 and 7, in the first embodiment, the threshold voltage for use in determination of multi-feed of sheets is corrected. On the other hand, the present embodiment differs from the first embodiment in that the timing of the analog-to-digital conversion performed by the analog-to-digital conversion circuit 9*c* included in the reception circuit 9 is corrected.

FIGS. 11A to 11C are diagrams each showing an example of analog-to-digital conversion timing set according to the distance between the ultrasonic sensors 6 and 7, and correspond to FIGS. 9A to 9C in the first embodiment, respectively. Therefore, "the distance between the sensors", "the sheet type", and "the temperature in the sheet feeder" used in FIGS. 11A to 11C are the same as "the distance between the sensors", "the sheet type", and "the temperature in the sheet feeder" used in FIGS. 9A to 9C. Further, similarly to FIG. 9A in the first embodiment, values of the threshold voltage associated with respective values of the distance between the sensors in the case of FIG. 11A where the temperature in the sheet feeder 301 is 25° C. are default settings.

Hereafter, the relationship between the distance between the sensors and the analog-to-digital conversion timing will be described using the example shown in FIG. 11A, in which the temperature in the sheet feeder is 25° C., as a representative.

As shown in FIG. 11A, the analog-to-digital conversion timing set according to the detected distance between the sensors is set by differentiating between the coated paper having a basis weight of less than 80 gsm, the coated paper having a basis weight of not less than 80 gsm and less than 128 gsm, and the other types of paper. The coated paper having a basis weight of less than 80 gsm, and the coated paper having a basis weight of not less than 80 gsm and less than 128 gsm have characteristics that attenuation of ultrasonic waves is small even when sheets are multi-fed, compared with the other types of paper, and there is little difference in attenuation of ultrasonic waves between the case where the sheets are multi-fed and the case where a single sheet is being fed normally. Due to this characteristics, the increase or decrease in the time required for ultrasonic waves to reach the ultrasonic sensor 7, caused by a change in the distance between the sensors, affects the voltage value output from the reception circuit 9 at the timing T1 (see FIGS. 8A to 8C), and hence the analog-to-digital conversion timing is corrected according to the distance between the sensors. On the other hand, the other types of paper are large in attenuation of ultrasonic waves when the sheets are multi-fed, and hence the increase or decrease in the time required for ultrasonic waves to reach the ultrasonic sensor 7, caused by a change in the distance between the sensors, does not affect the voltage value output from the reception circuit 9 at the timing T1. Therefore, the analog-to-digital conversion timing is not corrected.

A further description will be given of the coated paper having a basis weight of less than 80 gsm as a representative.

When the detected distance between the sensors is within a range of 20.0 mm±0.2 mm, the analog-to-digital conversion is performed at a time when 120 μs elapses after the pulse signal shown in FIG. 6A starts to be input to the transmission circuit 8. When the detected distance between the sensors is within a range of 20.3 mm to 20.5 mm, the distance between the sensors is increased. This delays the time at which the transmitted ultrasonic wave reaches the ultrasonic sensor 7 as the receiver unit. Therefore, if analog-to-digital conversion is performed at the time when 120 μs elapses as mentioned above, the voltage value output from the reception circuit 9 becomes lower. To avoid this inconvenience, the analog-to-digital conversion timing is delayed for a time period corresponding to the increase of the distance between the sensors, whereby the and analog-to-digital conversion timing is set to a time when 122.5 μs elapses. For the same reason, when the detected distance between the sensors is within a range of 20.6 mm to 20.8 mm, the analog-to-digital conversion timing set to a time when 125 μs elapses, and when the detected distance between the sensors is not smaller than 20.9 mm, the analog-to-digital conversion timing is set to a time when 127.5 μs elapses. When the detected distance between the sensors is within a range of 19.5 mm to 19.7 mm, the distance between the sensors is reduced. This advances the time at which the transmitted ultrasonic wave reaches the ultrasonic sensor 7 as the receiver unit. Therefore, if the analog-to-digital conversion is performed at a time when 120 μs elapses as mentioned above, the voltage value output from the reception circuit 9 becomes higher. To avoid this inconvenience, the analog-to-digital conversion timing is advanced by a time period corresponding to the decrease of the distance between the sensors, whereby the analog-to-digital conversion timing is set to a time when 117.5 μs elapses. For the same reason, when the detected distance between the sensors is within a range of 19.2 mm to 19.4 mm, the analog-to-digital conversion timing is set to a time when 115 μs elapses, and when the detected distance between the sensors is not larger than 19.1 mm, the analog-to-digital conversion timing is set to a time when 112.5 μs elapses.

Figure 12A:
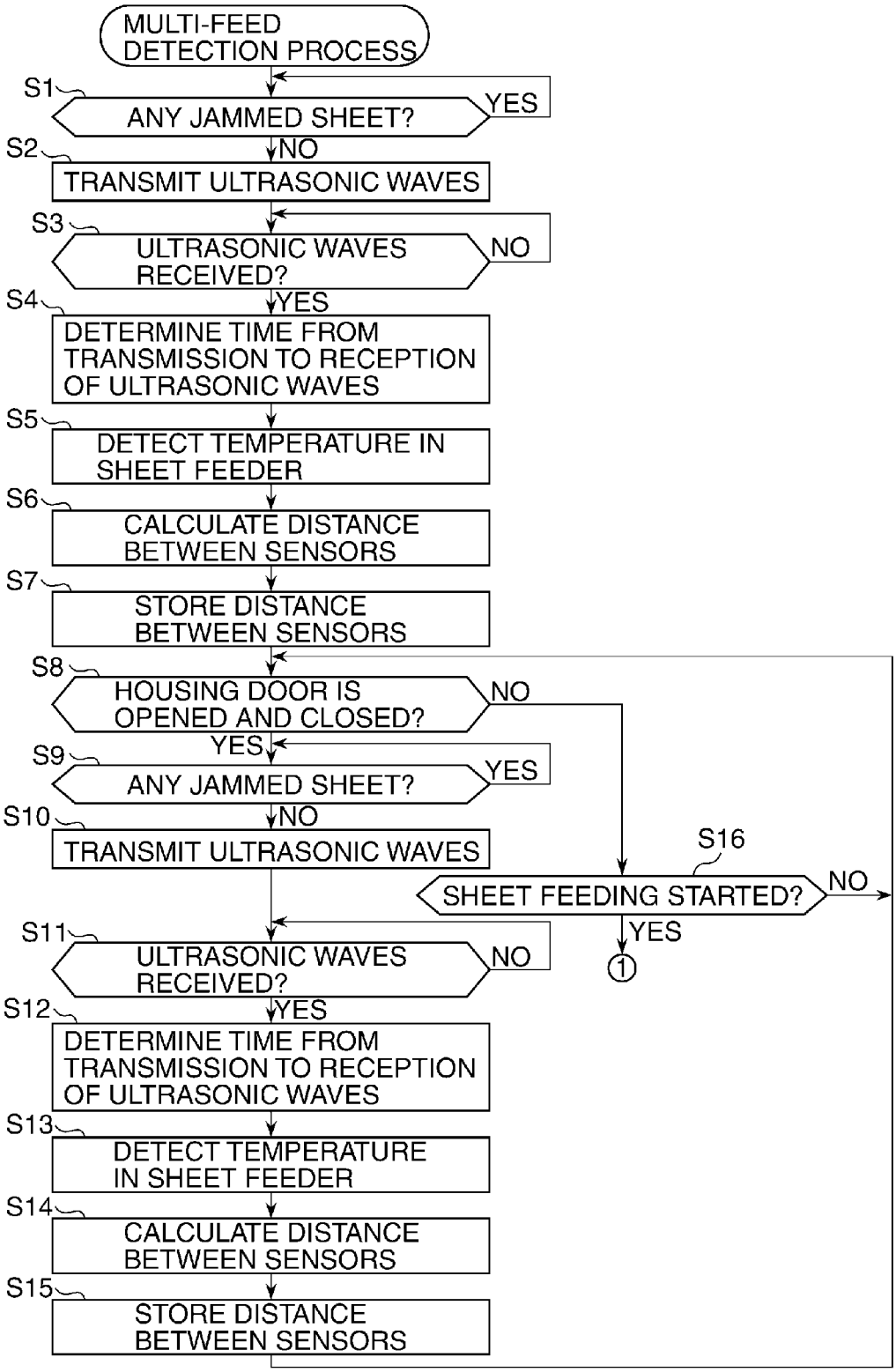
FIG. 12A is a flowchart of a multi-feed detection process executed by a CPU of an image forming system to which a sheet feeder according to a second embodiment of the present invention is applied.
Figure 12B:
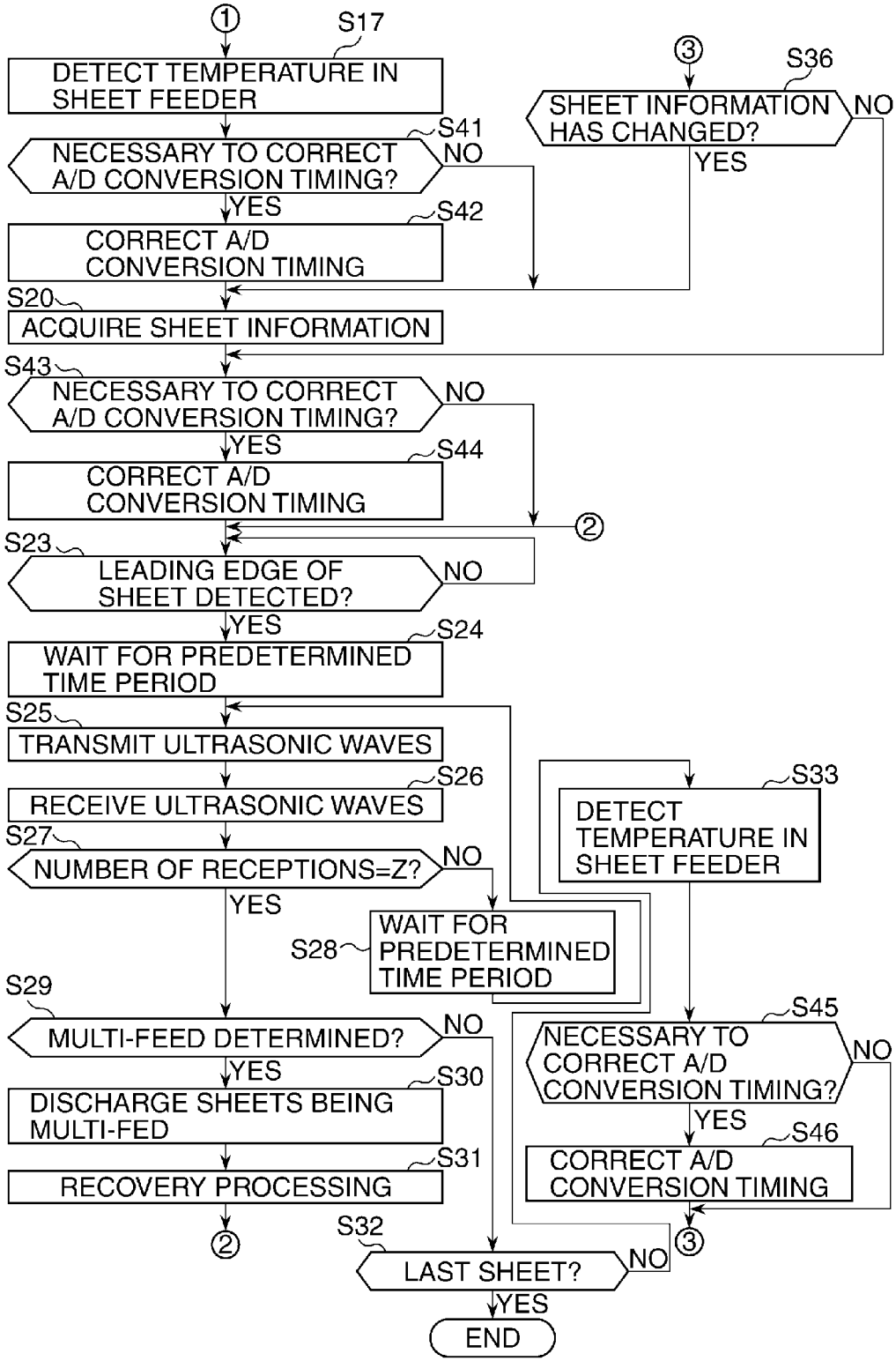
FIG. 12B is a continuation of FIG. 12A.

FIGS. 12A and 12B are a flowchart of a multi-feed detection process executed by the sheet feeder 301 according to the present embodiment, and more particularly by the CPU 1, and correspond to FIGS. 10A and 10B in the first embodiment. In FIGS. 12A and 12B, the same steps as those in FIGS. 10A and 10B are denoted by the same step numbers, and description thereof is omitted.

In the step S17 in FIG. 12B, the CPU 1 detects the temperature in the sheet feeder 301 at the start of feeding sheets using the temperature sensor 24. Then, the CPU 1 determines whether or not it is necessary to correct the analog-to-digital conversion timing according to a change in the temperature in the sheet feeder 301 (step S41). More specifically, if the temperature in the sheet feeder 301 detected in the step S17 is e.g. 25° C., the CPU 1 determines that it is not necessary to correct the analog-to-digital conversion timing according to a change in the temperature in the sheet feeder 301, and proceeds to the step S20. On the other hand, if the temperature in the apparatus detected in the step S17 has changed from 25° C. by a predetermined degree, the CPU 1 proceeds to a step S42. In the step S42, the CPU 1 corrects (changes) the analog-to-digital conversion timing to a timing associated with the value of the temperature in the sheet feeder 301 detected in the step S17 and the latest value of the distance between the sensors detected in the step S6 or S14.

In the step S20, the CPU 1 acquires the sheet information (e.g. surface property information and basis weight information) of sheets in a sheet container from which sheets are fed.

Next, the CPU 1 determines whether or not it is necessary to correct the analog-to-digital conversion timing according to a change in the distance between the sensors or a change in the sheet information (step S43). More specifically, the CPU 1 determines, based on the latest value of the distance between the sensors detected in the step S6 or S14 and the sheet information (e.g. surface property information and basis weight information) acquired in the step S20, whether or not to correct the analog-to-digital conversion timing from a setting in the case where the distance between the sensors is 20 mm. If it is determined in the step S43 that it is not necessary to correct the analog-to-digital conversion timing, the CPU 1 proceeds to the step S23. On the other hand, if it is necessary to correct the analog-to-digital conversion timing, the CPU 1 proceeds to a step S44. In the step S44, the CPU 1 determines a value of the analog-to-digital conversion timing based on the latest value of the distance between the sensors and the acquired sheet information, and corrects the analog-to-digital conversion timing to the determined value. As described above with reference to FIGS. 11A to 11C, when sheets of a type large in attenuation of ultrasonic waves in case of multi-feed are being conveyed, the increase or decrease in time required for the ultrasonic waves to reach the ultrasonic sensor 7, caused by a change in the distance between the sensors, does not significantly affect the voltage value output from the reception circuit 9. Therefore, in this case, the CPU 1 sets the analog-to-digital conversion timing without referring to the distance between the sensors, and it is not necessary to correct the analog-to-digital conversion timing. Therefore, the CPU 1 proceeds from the step S43 to the step S23 without executing the step S44.

If it is determined in the step S32 that the sheet is the last one, the CPU 1 terminates the present multi-feed detection process so as to terminate the sheet feeding operation by the sheet feeder 301. On the other hand, if the sheet is not the last one, the CPU 1 detects the temperature in the sheet feeder 301 so as to monitor for a change in the temperature in the sheet feeder 301 during the feed of this sheet (step S33).

Next, the CPU 1 determines whether or not it is necessary to correct the analog-to-digital conversion timing according to a change in the temperature in the sheet feeder 301, detected in the step S33 (step S45). Details of processing in the step S45 and a subsequent step S46 are the same as those in the steps S41 and S42, and hence description thereof is omitted.

As described above, in the present embodiment, the distance between the sensors is detected, when the sheet feeder 301 is powered on and when the housing door of the merged conveying passage section 319 is opened and closed before the start of feeding sheets, and the analog-to-digital conversion timing is corrected according to the detected distance between the sensors. Therefore, even when the distance between the sensors has changed, it is possible to accurately detect multi-feed of sheets.

Next, a description will be given of a third embodiment of the present invention. The sheet feeder according to the present embodiment differs from the sheet feeder according to the first embodiment only in part of the multi-feed detection process. Therefore, the image forming system including the sheet feeder according to the present embodiment has the same hardware configuration of the image forming system 1000 according to the first embodiment, i.e. the hardware configuration shown in FIGS. 1 to 5, and hence description of the components is omitted by denoting them using the same reference numerals.

Although in the first embodiment, the distance between the sensors is detected when the sheet feeder 301 is powered on, and when the housing door of the merged conveying passage section 319 is opened and closed before the start of feeding sheets, in the present embodiment, the distance between the sensors is detected before the start of feeding sheets.

Figure 13A:
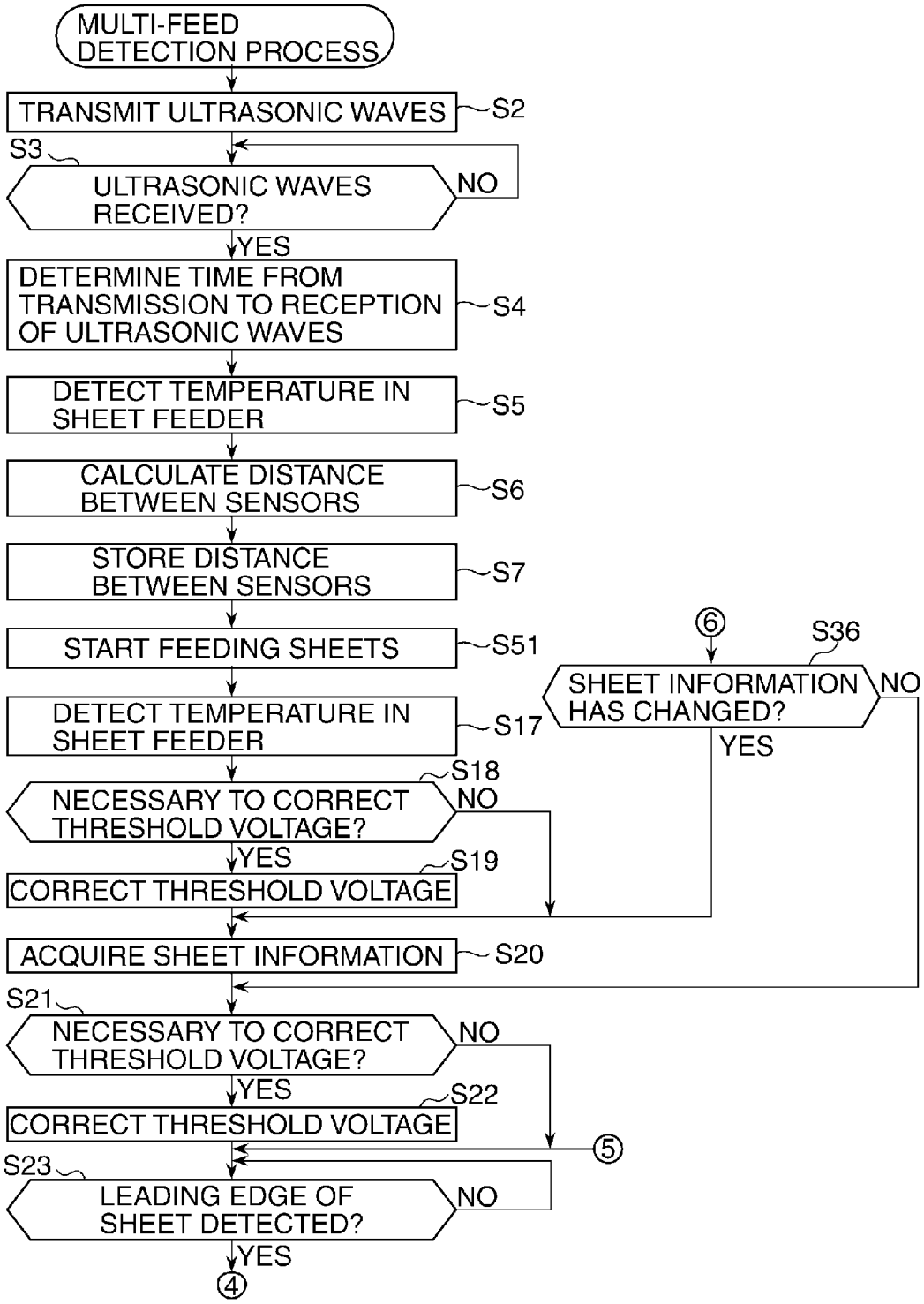
FIG. 13A is a flowchart of a multi-feed detection process executed by a CPU of an image forming system to which a sheet feeder according to a third embodiment of the present invention is applied.
Figure 13B:
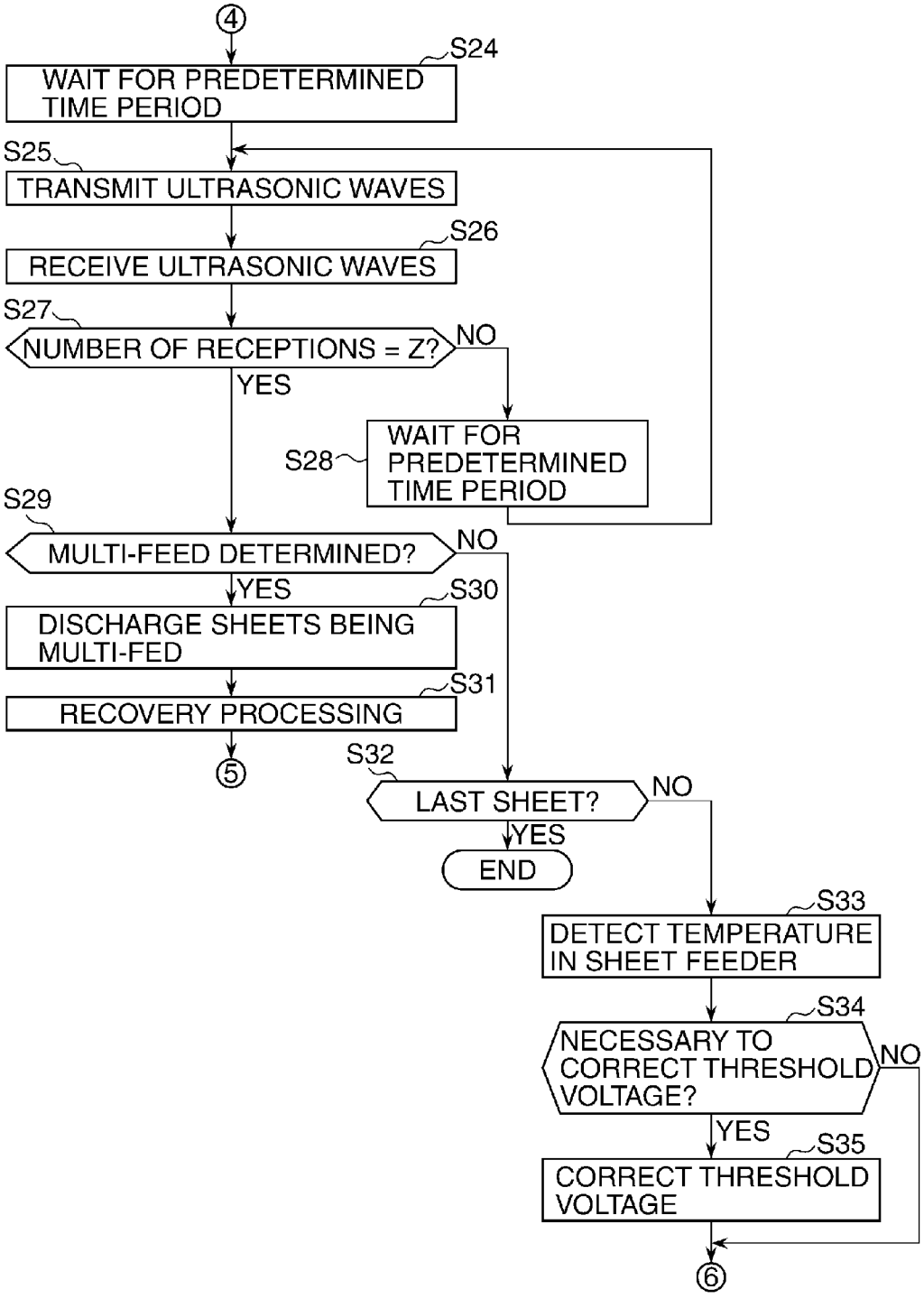
FIG. 13B is a continuation of FIG. 13A.

FIGS. 13A and 13B are a flowchart of a multi-feed detection process executed by the sheet feeder 301 according to the present embodiment, and more particularly by the CPU 1, and correspond to FIGS. 10A and 10B in the first embodiment. In FIGS. 13A and 13B, the same steps as those in FIGS. 10A and 10B are denoted by the same step numbers, and description thereof is omitted.

The multi-feed detection process in FIGS. 13A and 13B is formed by deleting the steps S1 and S8 to S16 from the multi-feed detection process in FIGS. 10A and 10B, and adding a step S51 after the step S7.

In the step S51, when the feed signal is output, the CPU 1 starts to feed sheets from the sheet container according to the feed signal.

As described above, in the present embodiment, the distance between the sensors is detected before feeding sheets in the sheet feeder 301, and the threshold voltage for use in the multi-feed determination is corrected according to the detected distance between the sensors, and hence even when the distance between the sensors has changed, it is possible to accurately detect multi-feed of sheets.

Next, a description will be given of a fourth embodiment of the present invention. The sheet feeder according to the present embodiment differs from the sheet feeder according to the second embodiment only in part of the multi-feed detection process. Therefore, the image forming system including the sheet feeder according to the present embodiment has the same hardware configuration of the image forming system 1000 according to the first embodiment, i.e. the hardware configuration shown in FIGS. 1 to 5, and hence description of the components is omitted by denoting them using the same reference numerals.

Although in the second embodiment, the distance between the sensors is detected when the sheet feeder 301 is powered on and when the housing door of the merged conveying passage section 319 is opened and closed before the start of feeding sheets, in the present embodiment, the distance between the sensors is detected before the start of feeding sheets.

Figure 14A:
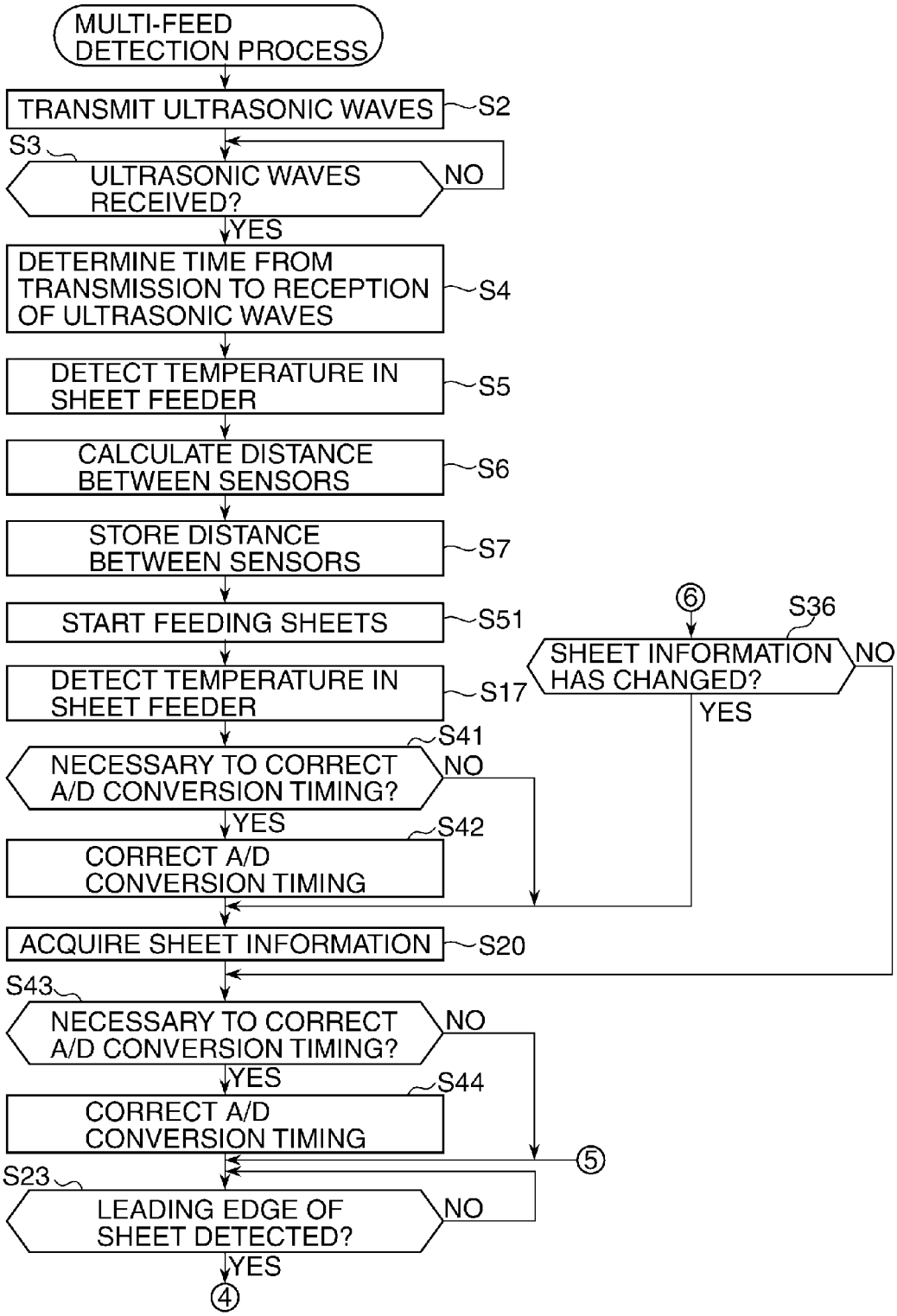
FIG. 14A is a flowchart of a multi-feed detection process executed by a CPU of an image forming system to which a sheet feeder according to a fourth embodiment of the present invention is applied.
Figure 14B:
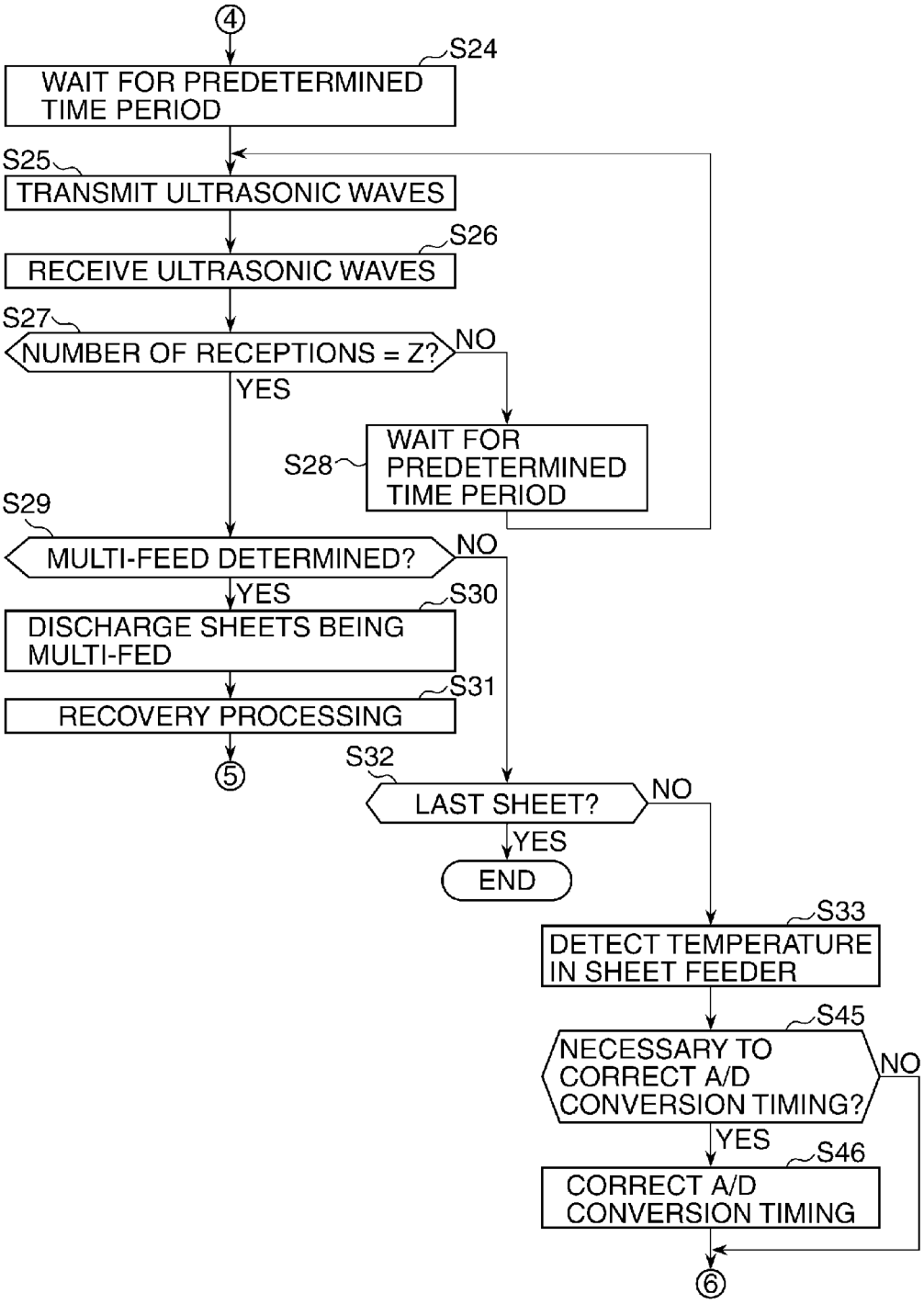
FIG. 14B is a continuation of FIG. 14A.

FIGS. 14A and 14B are a flowchart of a multi-feed detection process executed by the sheet feeder 301 according to the present embodiment, and more particularly by the CPU 1, and correspond to FIGS. 12A and 12B in the second embodiment. In FIGS. 14A and 14B, the same steps as those in FIGS. 12A and 12B are denoted by the same step numbers, and description thereof is omitted.

The multi-feed detection process in FIGS. 14A and 14B is formed by deleting the steps S1 and S8 to S16 from the multi-feed detection process in FIGS. 12A and 12B, and adding the step S51 after the step S7.

In the step S51, when the feed signal is output, the CPU 1 starts to feed sheets from the sheet container according to the feed signal.

As described above, in the present embodiment, the distance between the sensors is detected before the sheet feeder 301 starts to feed sheets, and the analog-to-digital conversion timing is corrected according to the detected distance between the sensors. Therefore, it is possible to positively detect multi-feed of sheets regardless of a change in the distance between the sensors, and it is possible to prevent the sheet feeder from erroneously detecting multi-feed when a single sheet is being fed normally.

Next, a description will be given of a fifth embodiment of the present invention. The sheet feeder according to the present embodiment differs from the sheet feeder according to the first embodiment only in part of the multi-feed detection process. Therefore, the image forming system including the sheet feeder according to the present embodiment has the same hardware configuration of the image forming system 1000 according to the first embodiment, i.e. the hardware configuration shown in FIGS. 1 to 5, and hence description of the components is omitted by denoting them using the same reference numerals. However, the merged conveying passage section 319 in the sheet feeder 301 according to the present embodiment differs from that shown in FIG. 7 in that the upper conveying path guide 319*a* and the lower conveying path guide 319*b* cannot be further spaced from each other, so that there can be no change in the distance between the sensors. However, the distance between the sensors has a variation within manufacturing tolerance caused during assembly of the unit, and a change in the distance between the sensors can be caused by replacement of the sensors after the image forming apparatus is shipped to market. Therefore, it is necessary to execute detection of the distance between the sensors.

Although in the first embodiment, the distance between the sensors is detected when the sheet feeder 301 is powered on and when the housing door of the merged conveying passage section 319 is opened and closed before the start of feeding sheets, in the present embodiment, the distance between the sensors is detected when the sheet feeder 301 is powered on.

Figure 15A:
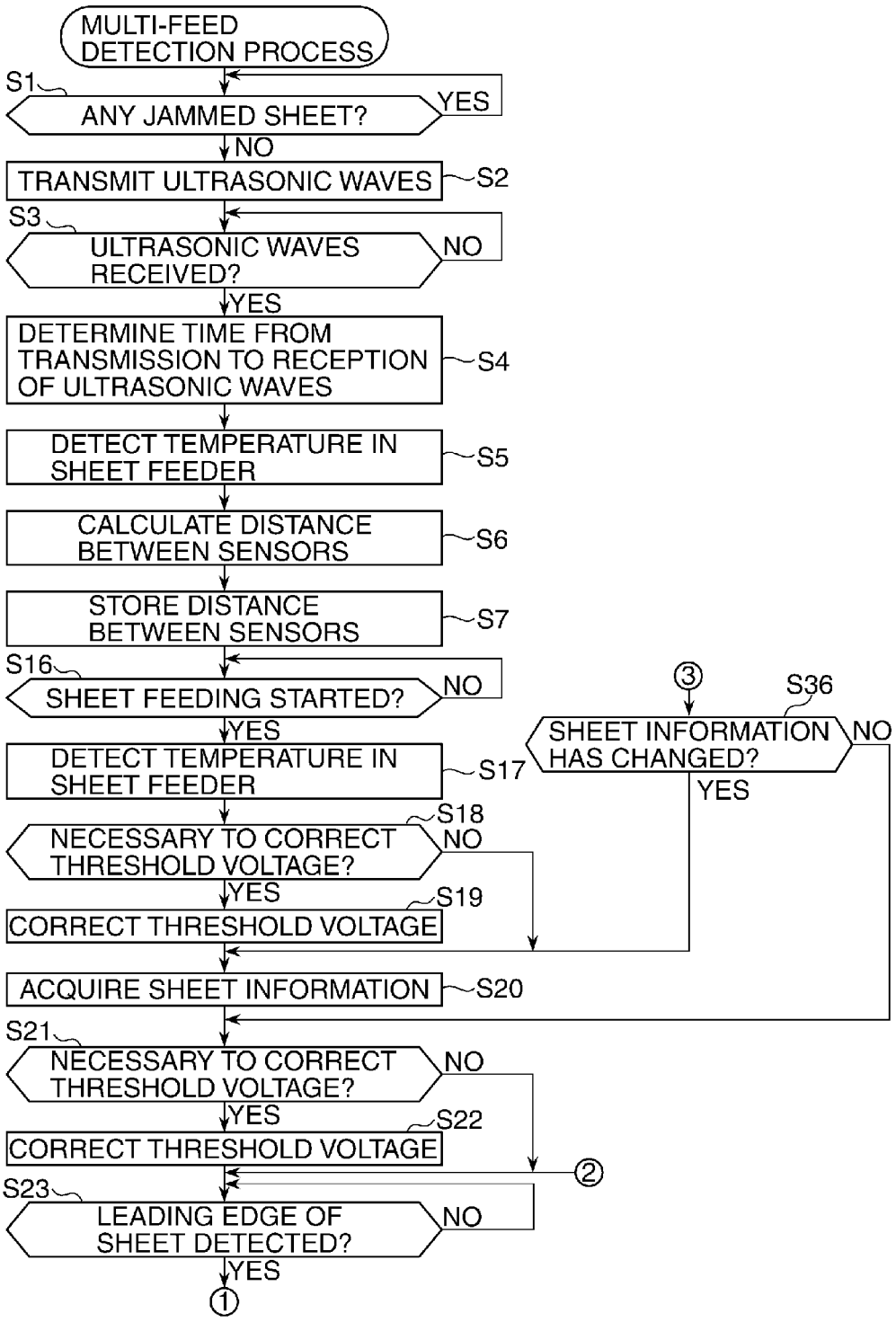
FIG. 15A is a flowchart of a multi-feed detection process executed by a CPU of an image forming system to which a sheet feeder according to a fifth embodiment of the present invention is applied.
Figure 15B:
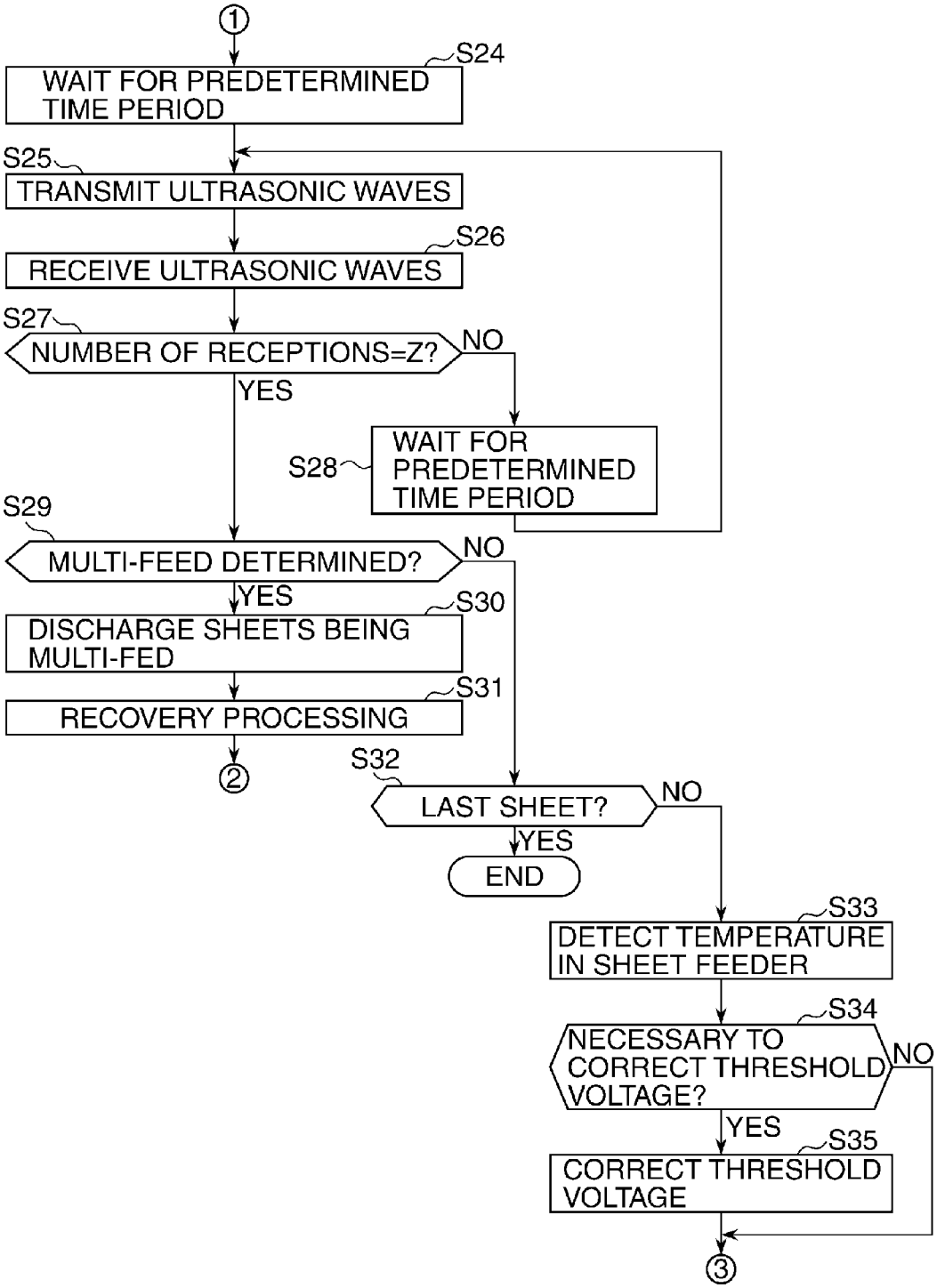
FIG. 15B is a continuation of FIG. 15A.

FIGS. 15A and 15B are a flowchart of a multi-feed detection process executed by the sheet feeder 301 according to the present embodiment, and more particularly by the CPU 1, and correspond to FIGS. 10A and 10B in the first embodiment. In FIGS. 15A and 15B, the same steps as those in FIGS. 10A and 10B are denoted by the same step numbers, and description thereof is omitted.

The multi-feed detection process in FIGS. 15A and 15B is formed by deleting the steps S8 to S15 from the multi-feed detection process in FIGS. 10A and 10B.

As described above, in the present embodiment, the distance between the sensors is detected when the sheet feeder 301 is powered on, and the threshold voltage for use in multi-feed determination is corrected according to the detected distance between the sensors. Therefore, even when the distance between the sensors has changed, it is possible to accurately detect multi-feed of sheets.

Next, a description will be given of a sixth embodiment of the present invention. The sheet feeder according to the present embodiment differs from the sheet feeder according to the second embodiment only in part of the multi-feed detection process. Therefore, the image forming system including the sheet feeder according to the present embodiment has the same hardware configuration of the image forming system 1000 according to the first embodiment, i.e. the hardware configuration shown in FIGS. 1 to 5, and hence description of the components is omitted by denoting them using the same reference numerals. However, the merged conveying passage section 319 in the sheet feeder 301 according to the present embodiment differs from that shown in FIG. 7 in that the upper conveying path guide 319*a* and the lower conveying path guide 319*b* cannot be further spaced from each other, so that there can be no change in the distance between the sensors. However, the distance between the sensors has a variation within manufacturing tolerance caused during assembly of the unit, and a change in the distance between the sensors can be caused by replacement of the sensors after the image forming apparatus is shipped to market. Therefore, it is necessary to execute detection of the distance between the sensors.

Although in the second embodiment, the distance between the sensors is detected when the sheet feeder 301 is powered on and when the housing door of the merged conveying passage section 319 is opened and closed before the start of feeding sheets, in the present embodiment, the distance between the sensors is detected when the sheet feeder 301 is powered on.

Figure 16A:
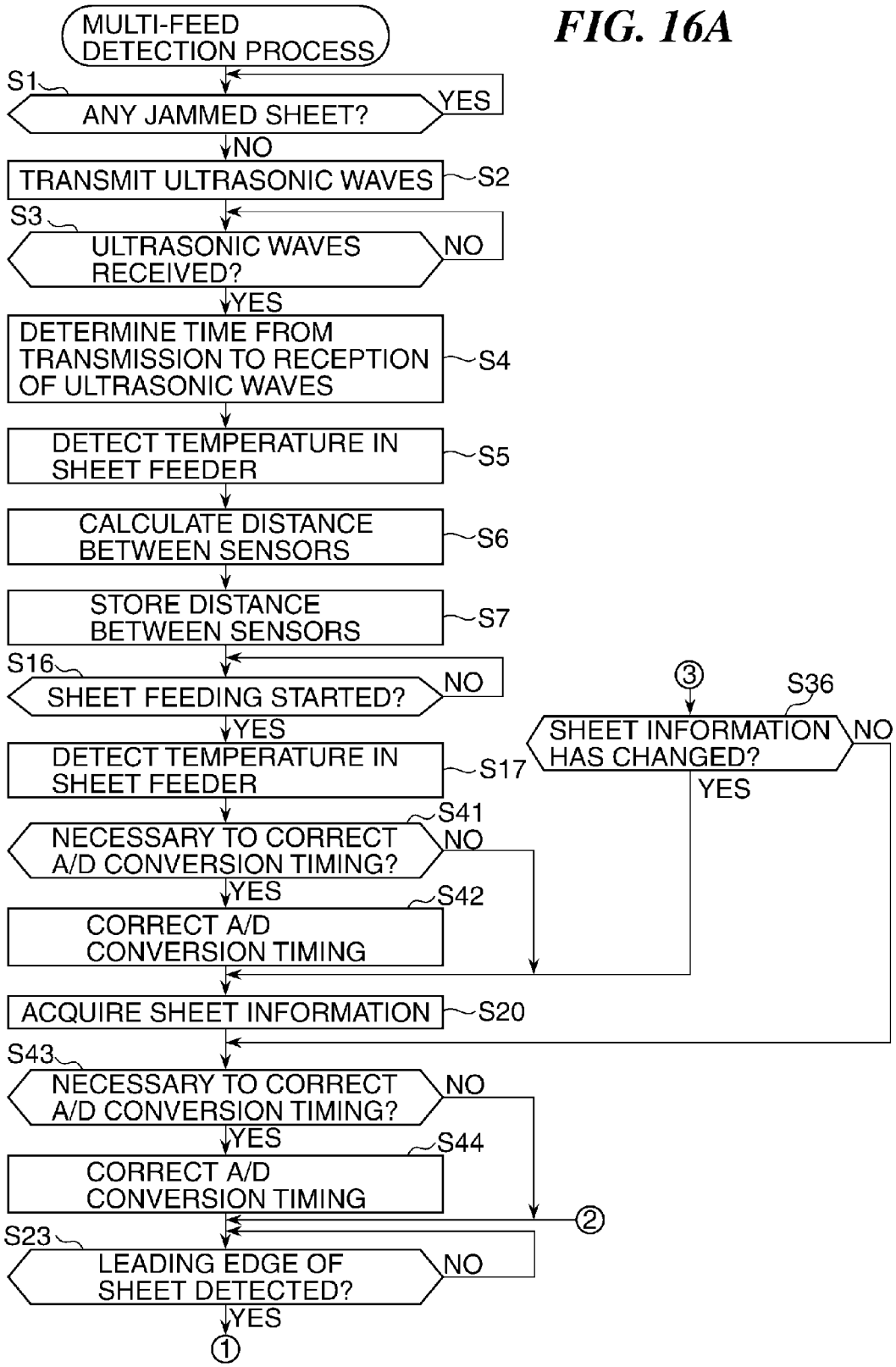
FIG. 16A is a flowchart of a multi-feed detection process executed by a CPU of an image forming system to which a sheet feeder according to a sixth embodiment of the present invention is applied.
Figure 16B:
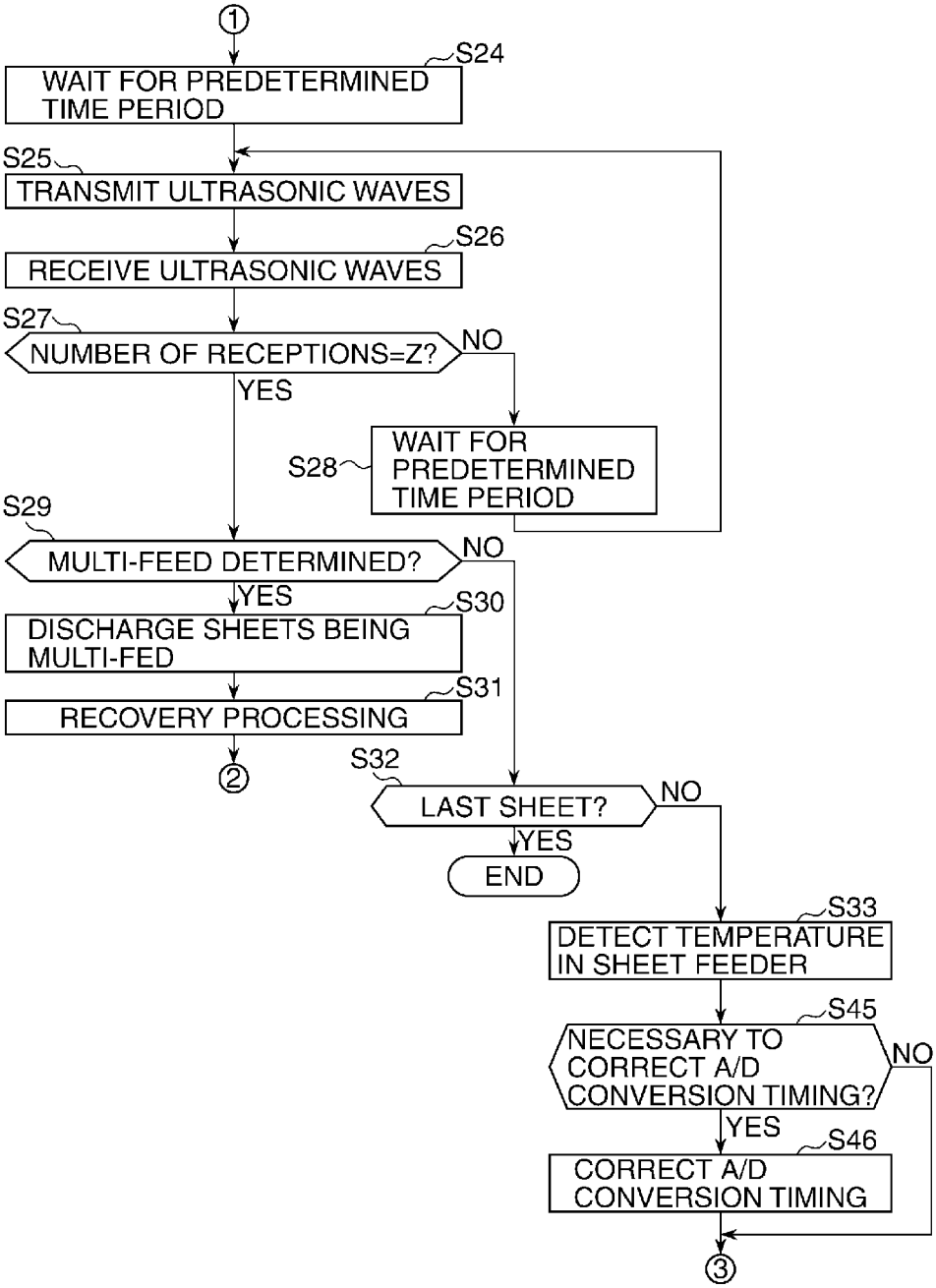
FIG. 16B is a continuation of FIG. 16A.

FIGS. 16A and 16B are a flowchart of a multi-feed detection process executed by the sheet feeder 301 according to the present embodiment, and more particularly by the CPU 1, and correspond to FIGS. 12A and 12B in the second embodiment. In FIGS. 16A and 16B, the same steps as those in FIGS. 12A and 12B are denoted by the same step numbers, and description thereof is omitted.

The multi-feed detection process in FIGS. 16A and 16B is formed by deleting the steps S8 to S15 from the multi-feed detection process in FIGS. 12A and 12B.

As described above, in the present embodiment, the distance between the sensors is detected when the sheet feeder 301 is powered on, and the analog-to-digital conversion timing is corrected according to the detected distance between the sensors. Therefore, even when the distance between the sensors has changed, it is possible to accurately detect multi-feed of sheets.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-165865, filed Jul. 26, 2012, which is hereby incorporated by reference herein in its entirety.

What is claimed is:

1. A sheet feeder comprising:

a container unit configured to contain a plurality of sheets;

a feeding unit configured to feed sheets from said container unit;

a transmitter configured to transmit ultrasonic waves to a sheet being fed by said feeding unit;

a receiver configured to receive ultrasonic waves transmitted by said transmitter;

a first detection unit configured to detect a level of ultrasonic waves received by said receiver;

a determination unit configured to determine whether or not sheets are being multi-fed, by comparing the level of ultrasonic waves detected by said first detection unit after lapse of a predetermined time period from transmission of the ultrasonic waves by said transmitter with a predetermined threshold value;

a second detection unit configured to detect a distance between said transmitter and said receiver; and a changing unit configured to change at least one of the predetermined time period and the predetermined threshold value based on the distance detected by said second detection unit.

2. The sheet feeder according to claim 1, further comprising a movable guide member which forms a conveying path along which sheets are conveyed, and wherein at least one of said transmitter and said receiver is moved according to movement of said movable guide member.

3. The sheet feeder according to claim 1, further comprising a measurement unit configured to measure an elapsed time after the transmission of ultrasonic waves by said transmitter until reception of the ultrasonic waves by said receiver, in a state where there is no sheet being conveyed, and wherein said second detection unit detects the distance between said transmitter and said receiver by multiplying the elapsed time measured by said measurement unit by a sonic speed.

4. The sheet feeder according to claim 1, further comprising a temperature detection unit configured to detect temperature in the sheet feeder, and wherein said second detection unit uses, as the sonic speed, a sonic speed determined based on the temperature detected by said temperature detection unit.

5. The sheet feeder according to claim 1, further comprising a temperature detection unit configured to detect temperature in the sheet feeder, and wherein said changing unit changes at least one of the predetermined time period and the predetermined threshold value based on the temperature detected by said temperature detection unit.

6. The sheet feeder according to claim 2, wherein said changing unit changes at least one of the predetermined time period and the predetermined threshold value, at predetermined timing after said movable guide member has been moved.

7. An image forming apparatus comprising:

a container unit configured to contain a plurality of sheets;

a feeding unit configured to feed sheets from said container unit;

a transmitter configured to transmit ultrasonic waves to a sheet being fed by said feeding unit;

a receiver configured to receive ultrasonic waves transmitted by said transmitter;

a first detection unit configured to detect a level of ultrasonic waves received by said receiver;

a determination unit configured to determine whether or not sheets are being multi-fed, by comparing the level of ultrasonic waves detected by said first detection unit after lapse of a predetermined time period from transmission of the ultrasonic waves by said transmitter with a predetermined threshold value;

a second detection unit configured to detect a distance between said transmitter and said receiver;

a changing unit configured to change at least one of the predetermined time period and the predetermined threshold value based on the distance detected by said second detection unit; and an image forming unit configured to form an image on a sheet which is determined by said determination unit not to be being multi-fed.

8. The image forming apparatus according to claim 7, further comprising a movable guide member which forms a conveying path along which sheets are conveyed, and wherein at least one of said transmitter and said receiver is moved according to movement of said movable guide member.

9. The image forming apparatus according to claim 7, further comprising a measurement unit configured to measure an elapsed time after the transmission of ultrasonic waves by said transmitter until reception of the ultrasonic waves by said receiver, in a state where there is no sheet being conveyed, and wherein said second detection unit detects the distance between said transmitter and said receiver by multiplying the elapsed time measured by said measurement unit by a sonic speed.

10. The image forming apparatus according to claim 7, further comprising a temperature detection unit configured to detect temperature in the sheet feeder, and wherein said second detection unit uses, as the sonic speed, a sonic speed determined based on the temperature detected by said temperature detection unit.

11. The image forming apparatus according to claim 7, further comprising a temperature detection unit configured to detect temperature in the sheet feeder, and wherein said changing unit changes at least one of the predetermined time period and the predetermined threshold value based on the temperature detected by said temperature detection unit.

12. The image forming apparatus according to claim 8, wherein said changing unit changes at least one of the predetermined time period and the predetermined threshold value, at predetermined timing after said movable guide member has been moved.

* * * * *